US010123131B2

(12) United States Patent
Liu et al.

(10) Patent No.: US 10,123,131 B2
(45) Date of Patent: Nov. 6, 2018

(54) MICROELECTROMECHANICAL MICROPHONE WITH DIFFERENTIAL CAPACITIVE SENSING

(71) Applicant: INVENSENSE, INC., San Jose, CA (US)

(72) Inventors: Fang Liu, San Jose, CA (US); Michael Daneman, Campbell, CA (US); Thomas Chen, Cambridge, MA (US)

(73) Assignee: INVENSENSE, INC., San Jose, CA (US)

( * ) Notice: Subject to any disclaimer, the term of this patent is extended or adjusted under 35 U.S.C. 154(b) by 152 days.

(21) Appl. No.: 14/733,560

(22) Filed: Jun. 8, 2015

(65) Prior Publication Data

US 2016/0360322 A1 Dec. 8, 2016

(51) Int. Cl.
*H04R 31/00* (2006.01)
*H04R 19/04* (2006.01)
*H04R 19/00* (2006.01)

(52) U.S. Cl.
CPC ..... *H04R 19/04* (2013.01); *H04R 19/005* (2013.01); *H04R 31/00* (2013.01)

(58) Field of Classification Search
CPC ..... H04R 19/005; H04R 19/04; H04R 31/00; H04R 7/16; H04R 2201/003; H04R 2201/00
See application file for complete search history.

(56) References Cited

U.S. PATENT DOCUMENTS 5,327,504 A * 7/1994 Hobelsberger ..... H04R 1/227 381/350
8,059,842 B2 * 11/2011 Suzuki ..... H04R 19/04 381/173
2006/0169049 A1 * 8/2006 Matsubara ..... B81B 7/0006 73/754
2006/0284516 A1 * 12/2006 Shimaoka ..... H04R 19/04 310/322
2014/0133685 A1 * 5/2014 Liu ..... H04R 7/20 381/355

* cited by examiner

*Primary Examiner* — Duc Nguyen
*Assistant Examiner* — Taunya McCarty
(74) *Attorney, Agent, or Firm* — Amin, Turocy & Watson, LLP

(57) ABSTRACT

Microelectromechanical microphones include structures that permit differential capacitive sensing. In certain structures, a movable plate is disposed between a rigid plate and a substrate. A first capacitor is formed between the movable plate and the substrate and a second capacitor is formed between the movable plate and the rigid plate. Respective bias voltages can be applied to the rigid plate and the substrate, and a differential capacitive signal can be probed in response to displacement of the movable plate caused by a pressure wave. The movable plate and the rigid plate are mechanically coupled to first and second portions of the substrate, respectively. A dielectric member mechanically couples the movable plate and the rigid plate, thus providing mechanical stability.

13 Claims, 19 Drawing Sheets

MICROELECTROMECHANICAL MICROPHONE WITH DIFFERENTIAL CAPACITIVE SENSING

BACKGROUND

Certain microelectromechanical microphones rely on differential capacitive sensing to generate a capacitive signal representative of an audible signal. To such an end, complex structures including a diaphragm and multiple backplates are implemented, typically resulting in complex manufacturing flows and costly devices.

SUMMARY

The following presents a simplified summary of one or more of the embodiments in order to provide a basic understanding of one or more of the embodiments. This summary is not an extensive overview of the embodiments described herein. It is intended to neither identify key or critical elements of the embodiments nor delineate any scope of embodiments or the claims. This Summary's sole purpose is to present some concepts of the embodiments in a simplified form as a prelude to the more detailed description that is presented later. It will also be appreciated that the detailed description may include additional or alternative embodiments beyond those described in the Summary section.

The present disclosure recognizes and addresses, in at least certain embodiments, the issue of providing microelectromechanical microphones having differential capacitive sensing capabilities. The disclosure provides embodiments of microelectromechanical microphones microelectromechanical microphones including structures that permit differential capacitive sensing. The disclosure also provides embodiments of methods for fabricating the disclosed structures. More specifically, in one embodiment, the disclosure provides a microelectromechanical microphone that can include a substrate that defines an acoustic port configured to receive an acoustic wave. The microelectromechanical microphone also can include, for example, a movable diaphragm having a first portion rigidly coupled to the substrate and a second portion that is flexibly coupled to the first portion. The movable diaphragm and the substrate can form a first capacitor that has a first capacitance based on a displacement of the movable diaphragm caused by the acoustic wave. In addition, the microelectromechanical microphone can include a backplate, such as a stationary, rigid plate. The backplate can be mechanically coupled to the movable diaphragm via one or more dielectric members. In certain implementations, each of the one or more dielectric members can extend between a surface of the backplate and a surface of the movable diaphragm. The backplate and the movable diaphragm can form a second capacitor that has a second capacitance based on the displacement of the movable diaphragm.

Other embodiments and various examples, scenarios and implementations are described in more detail below. The following description and the drawings set forth certain illustrative embodiments of the specification. These embodiments are indicative, however, of but a few of the various ways in which the principles of the specification may be employed. Other advantages and novel features of the embodiments described will become apparent from the following detailed description of the specification when considered in conjunction with the drawings.

DETAILED DESCRIPTION

The disclosure recognizes and addresses, in at least certain embodiments, the issue of providing microelectromechanical microphones based on differential capacitive sensing, without multiple perforated backplates and associated complex fabrication processes. To that end, the disclosure provide structures that permit capacitive differential sensing in microelectromechanical microphones. Other embodiments provide methods for fabricating such structures. In certain structures, a movable plate is disposed between a rigid plate and a portion of a substrate, each of which forms an electrode. Displacement of the movable plate in response to a pressure wave permits generating a differential capacitive signal representative of an acoustic signal and/or an ultrasonic signal propagated by the pressure wave. The flexible plate and the rigid plate can embody or can include, respectively, a movable diaphragm and a backplate of a microelectromechanical microphone in accordance with this disclosure. A first capacitor is formed between the movable plate and the substrate and a second capacitor is formed between the movable plate and the rigid plate. Respective bias voltages can be applied to the rigid plate and the substrate, and a differential capacitive signal can be probed in response to displacement of the movable plate caused by a pressure wave. The movable plate and the rigid plate are mechanically coupled to first and second portions of the substrate, respectively. A dielectric member mechanically couples the movable plate and the rigid plate, thus providing mechanical stability. Embodiments of the disclosure also provides methods for fabricating structures that permit differential capacitive sensing.

When compared to conventional technologies, the microelectromechanical microphones of the disclosure can be achieved with a simplified, more flexible design that can reduce complexity of fabrication process flow, with associated lower costs of fabrication. Such a design permits essentially any configuration of openings in a backplate of a micromechanical microphone in accordance with aspects of this disclosure. Microelectromechanical microphones of this disclosure also can provide greater performance (e.g., higher sensitivity and/or fidelity) when compared to microelectromechanical microphones having more complex arrangements of backplates and diaphragm. The disclosed structures can provide greater shock robustness than structures present in conventional microelectromechanical microphones.

Figure 1:
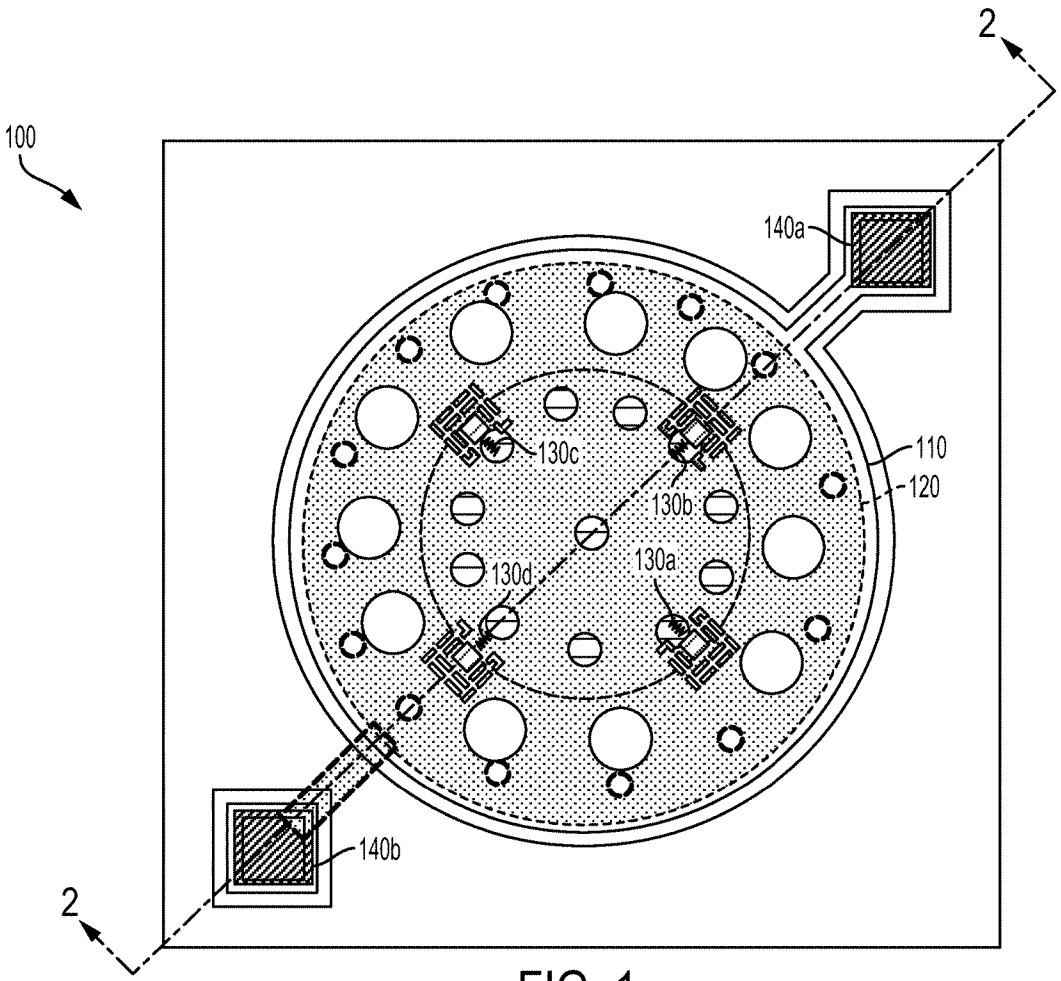
FIG. 1 illustrates a top view of an example of a microelectromechanical microphone die in accordance with one or more embodiments of the disclosure.

With reference to the drawings, FIG. 1 illustrates an example of a microelectromechanical microphone die 100 in accordance with one or more embodiments of the disclosure. As illustrated, the microelectromechanical microphone die includes a rigid plate 110 and a movable plate 120. It should be appreciated that the periphery of the movable plate 120 is illustrated with a dashed arrow for the sake of clarity, not to convey that inclusion of the movable plate 120 is optional. Both of such plates are solid and can be at least partially suspended. The rigid plate 110 can be referred to as backplate 110 in view that it overlays the movable plate 120, which is configured to receive a pressure wave (e.g., an acoustic wave and/or ultrasonic wave). The pressure wave can be received via an opening in a semiconductor substrate that provides, at least in part, for the movable plate 120. Each of the rigid plate 110 and the movable plate 120 can be formed from or can include a semiconductor or a metal. For instance, the semiconductor can be one of silicon (polycrystalline or crystalline), germanium, a semiconductor from group III, a semiconductor from group V, a semiconductor from group II, a semiconductor from group VI, or a combination of two or more of the foregoing. In addition, the metal can be one of gold, silver, platinum, titanium, other types of noble metal, aluminum, copper, tungsten, chromium, or an alloy of two or more of the foregoing.

The microelectromechanical microphone die 100 also can include a metal pad 140*a* and a metal pad 140*b*, each of which can permit electrically coupling a portion of the microelectromechanical microphone die 100 to a voltage source, a current source, or other type of device (e.g., an ASIC, a FPGA, or another type of processor). Specifically, the metal pad 140*a* can permit electrically coupling the rigid plate 110 to an external device, and the metal pad 140*b* can permit electrically coupling the movable plate 120 to a second external device. As such, the metal pads 140*a* and 140*b* can permit applying respective voltages to the rigid plate 110 and the movable plate 120. Each of such metal pads can embody or can constitute an Ohmic contact. Metal pad 140*a* can be formed from the same or a different metal than metal pad 140*b*. Metals that can form the metal pad 140*a* and/or the metal pad 140*b* can include, for example, gold, silver, platinum, titanium, other types of noble metal, aluminum, copper, tungsten, chromium, or an alloy of two or more of the foregoing.

Figure 2:
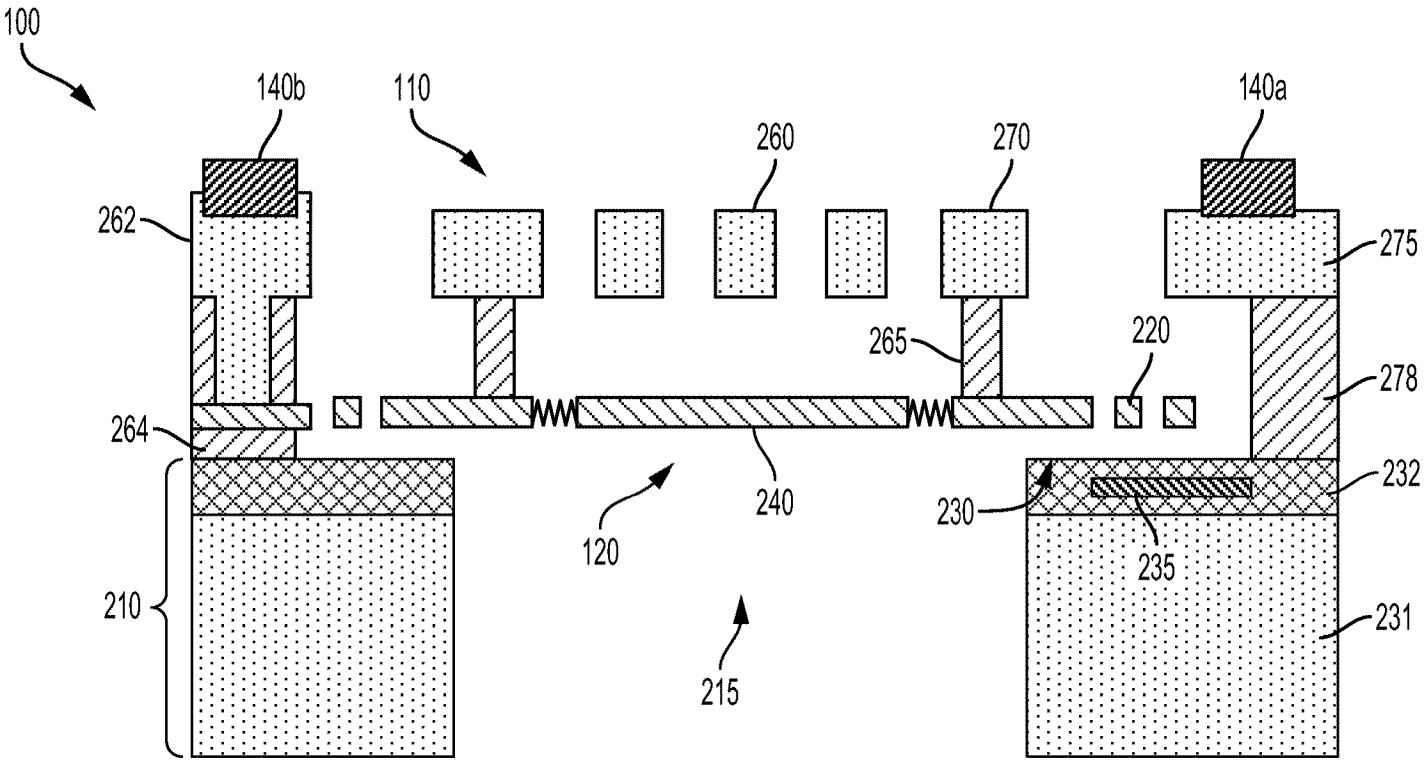
FIG. 2 illustrates a cross-sectional view of the example microelectromechanical microphone die of FIG. 1.

The rigid plate 110 is perforated to reduce streaming resistance of air (or other fluid) and/or damping in response to the movement of the movable plate 120 between the rigid plate 110 and a substrate (see FIG. 2). Each of the rigid plate 110 and the movable plate 120 can define openings arranged in a specific pattern, each opening having a specific size and shape (such as a circle of specific diameter). As illustrated, such openings can be defined in an outer region of the movable plate 120. Size and/or shape of an opening defined by the rigid plate 110 can be the same or different from size and/or shape of an opening defined by the movable plate 120. Similarly, a pattern of openings defined by the rigid plate 110 can be the same or different from a pattern of openings defined by the movable plate 120. It should be appreciated that, in certain embodiments, the rigid plate 110 can be solid, without openings.

The movable plate 120 can embody or can constitute a diaphragm of a microelectromechanical microphone formed from the microelectromechanical microphone die 100. The movable plate 120 can include or can be formed from an electrically conducting material, such as a doped semiconductor or a metal. For instance, the movable plate 120 can be formed from doped polycrystalline silicon or another type of doped semiconductor. The movable plate 120 can be flexible and, thus, can be referred to as flexible diaphragm 120. In certain embodiments, the movable plate 120 can include a portion that is mechanically coupled, via flexible members 130*a*-130*d*, for example, to a second portion of the movable plate 120. While four flexible members are depicted, it should be appreciated that, in certain embodiments, other number of elastic solid members can provide the mechanical coupling.

The rigid plate 110, the movable plate 120, and a substrate that supports such plates can permit differential capacitive sensing by utilizing changes in capacitance of a capacitor formed between the rigid plate 110 and the movable plate 120, and changes in capacitance of a second capacitor formed between the movable plate 120 and the substrate. Such changes can be caused by a pressure wave impinging onto the movable plate 120. It should be appreciated that differential capacitive sensing can be achieved with a single rigid plate and a substrate which is typically present in microelectromechanical dies. As illustrated, a portion of the rigid plate 110 can be mechanically coupled (e.g., rigidly coupled) to the substrate at a region proximate to the metal pad 140*a*, and other portions (e.g., a periphery) of the rigid plate 110 can be unattached to the substrate or otherwise suspended. In certain embodiments, one or more of those other portions can be flexibly coupled to the substrate. Similarly, a portion of the movable plate 120 can be mechanically coupled (e.g., rigidly coupled) to the substrate at a region proximate to the metal pad 140*b*. Such a portion is highlighted in FIG. 1 with a thick dashed-line rectangle. Other portions (e.g., a periphery) of the movable plate 110 can be unattached to the substrate or otherwise suspended. Further, as described herein, another portion of the movable plate 120 can be flexibly coupled to the portion that can be rigidly coupled to the substrate.

More specifically, as illustrated in FIG. 2, the example microelectromechanical microphone die 100 can provide differential capacitive sensing by leveraging mechanical coupling between the rigid plate 110 and the movable plate 120. A substrate 210 defines an opening 215 configured to receive an acoustic wave or other type of pressure wave. The substrate 210 can include a semiconductor layer 231 and a dielectric layer 232. The substrate 210 also can include an electrode 235 (e.g., a metal, a doped semiconductor, or the like) embedded within the dielectric layer 232 and beneath a surface 230 thereof. As such, the electrode 235 can be electrically isolated. A portion of the substrate 210 can form a capacitor with a portion of the movable plate 120. More specifically, for example, the capacitor can be formed between a portion 220 of the movable plate 120 and the electrode 235. Dielectric material between the electrode 235 and the surface 230 and air or other fluid in the gap between the portion 220 and the surface 230 of the substrate 210 embody or constitute a dielectric medium of such a capacitor. Therefore, in the illustrated embodiment, a capacitance is formed between the movable plate 120 and the electrode 235. In addition, another portion of the movable plate 120 can form a capacitor with a portion of the rigid plate 110. For example, a gap between a portion 240 of the movable plate 120 and a portion 260 of the rigid plate 110 can form the capacitor. In certain embodiments, the movable plate 120 can be mechanically coupled or otherwise anchored to the rigid plate 110 via one or more dielectric members (e.g., a semiconductor oxide shell, semiconductor oxide posts, a silicon nitride shell, silicon nitride posts, or the like), each of the one or more dielectric members extending from a surface of the movable plate 120 to a surface of the rigid plate 110. In certain embodiments, a dielectric member 265 can extend from a surface of a portion of the movable plate 120 to a surface of a portion 270 of the rigid plate 110. In one example, the dielectric member 265 can be embodied in a circular dielectric shell of a defined thickness. It should be appreciated that the dielectric member 265, in certain implementations, can be embodied in a shell having a square cross-section, a hexagonal cross-section, or other types of cross-sections besides a circular cross-section. The thickness can range, for example, from about 0.1 μm to about 10 μm. The one or more dielectric members can provide mechanical stability to the rigid plate 110 and the movable plate 120 preventing collapse of one or more of such plates. As described herein, it should be appreciated that in the absence of the one or more dielectric members, a portion of the rigid plate 110 (e.g., a portion proximate to a region in which the rigid plate is mechanically coupled to the substrate 210) would be suspended or otherwise flexibly coupled to the substrate. Similarly, a portion of the movable plate 120 also would be suspended or otherwise flexibly coupled to another portion of the substrate.

Differential capacitive sensing can be implemented by probing relative changes between a capacitance C of the capacitor formed between the portion 220 and the substrate 210 and a capacitance C' of the capacitor formed between the portion 240 and the rigid plate 110. To that end, each of the substrate 210, the rigid plate 110, and the movable plate 120 can be subjected to an applied voltage. The substrate 210 can form an electrode and, thus, a voltage can be applied thereto. Accordingly, the substrate 210 can be embodied in or can include conductive material, such as a doped semiconductor (e.g., p-type silicon) or a metal. In one example, a metal can be deposited in a region (not depicted) within the substrate 210. As such, a voltage can be applied at such an electrode (which can be referred to as a substrate electrode).

The microelectromechanical microphone die 100 of the disclosure also permits application of a voltage to the movable plate 120. More specifically, the movable plate 120 can be electrically isolated from the substrate 210 via a dielectric layer (e.g., a semiconductor oxide or another insulator). The dielectric layer also can mechanically couple or otherwise can permit attachment of a portion 260 of the movable plate 120 to the substrate 210. Other portions of the movable plate 120 are suspended (e.g., portion 220) and, thus, also are electrically isolated from the substrate 210. In addition, a member 262 between the metal pad 140*b* and the portion 264 can permit applying the voltage to the movable plate 120. The member 262 is electrically isolated from the rigid plate 110. In certain embodiments, the member 262 can be formed or can include the same material utilized in the rigid plate 110.

Further, the metal pad 140*a* can permit the application of a voltage to the rigid plate 110. As illustrated in FIG. 2, a portion 275 of the rigid plate 110 can be electrically isolated from the substrate 210 via a dielectric member 278 (e.g., a semiconductor oxide or another insulator). The dielectric member 278 also can mechanically couple or otherwise can attach the portion 270 of the rigid plate 110 to the substrate 210.

Figure 3:
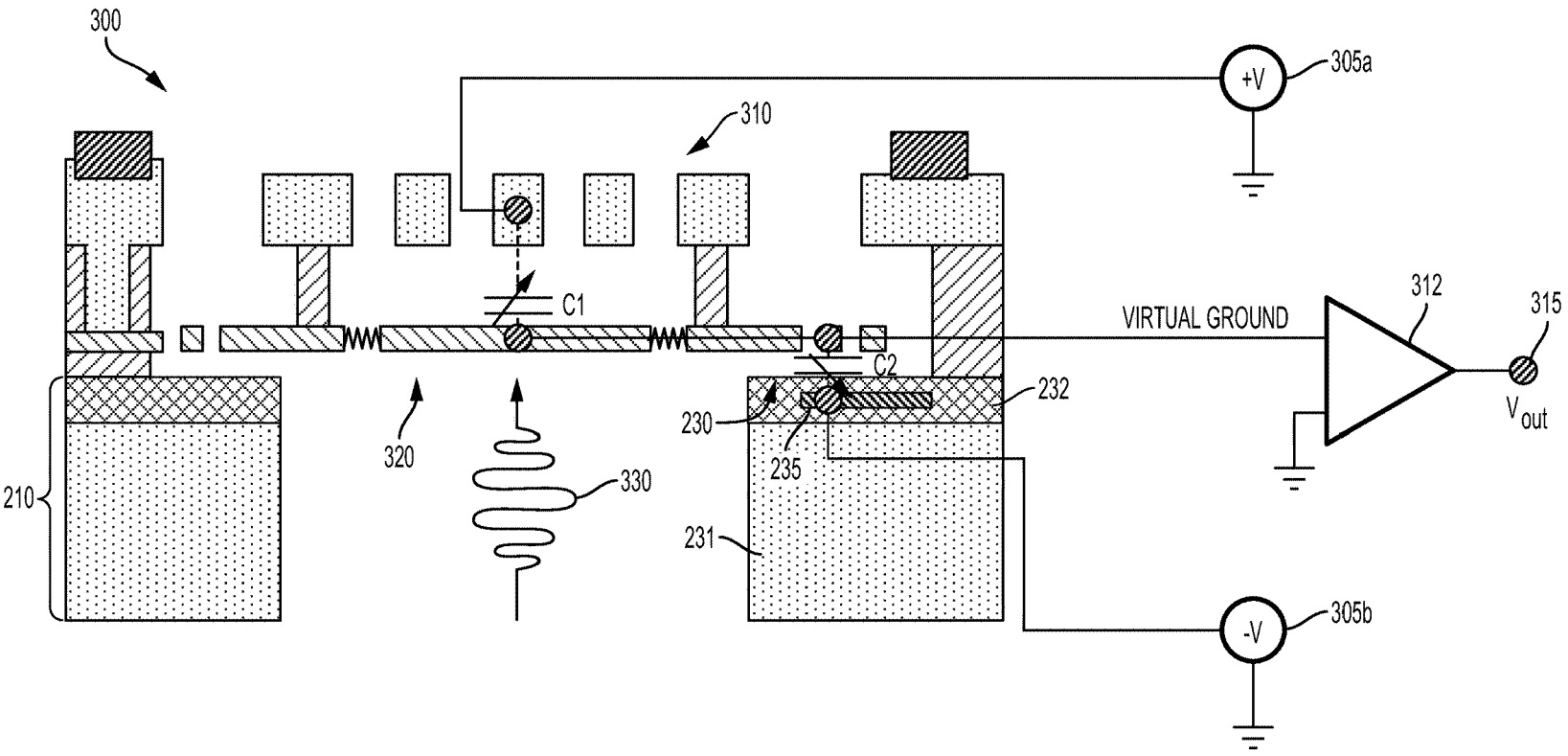
FIG. 3 illustrates an example of sensing architecture for differential capacitive sensing in accordance with one or more embodiments of the disclosure.

FIG. 3 schematically presents an example of sensing architecture for differential capacitive sensing in accordance with one or more embodiments of the disclosure. The architecture includes a microelectromechanical microphone die 300 having the same structural features as the microelectromechanical microphone die 100 described herein. The microelectromechanical microphone die 300 includes a rigid backplate 310 having the same structure as the rigid backplate 110, and a flexible diaphragm 320 having the same structure as the flexible diaphragm 120. As illustrated, the rigid backplate 310 and the flexible diaphragm 310 are mechanically coupled by a dielectric member in accordance with aspects of this disclosure. The rigid backplate 310 and the flexible diaphragm 320 can constitute, respectively, a first electrode and a second electrode. The first and second electrodes may be referred to as backplate electrode and diaphragm electrode, respectively. A portion of the substrate 210 also can constitute a third electrode (which may be referred to as a substrate electrode). Bias voltages 305*a* and 305*b* having the same magnitude and opposite polarity, for example, can be applied to the first electrode and the third electrode. The diaphragm electrode can be connected to a virtual ground of an operational amplifier 312 in order to minimize parasitic capacitance, so sensitivity of the sensing architecture can be increased and circuit noise can be reduced.

The rigid backplate 310 and the flexible diaphragm 320 form a first capacitor having a capacitance C1, and the diaphragm and a portion of the substrate 210 form a second capacitor having a second capacitance C2. In certain embodiments, C1 and C2 could be designed to match a specific ratio in the absence of a pressure wave (e.g., acoustic wave), so that total charge at the first capacitor C1 is essentially equal to total charge at the second capacitor. Capacitances C1 and C2 are variable and change in response to a pressure wave impinging on the flexible diaphragm 320. Specifically, the movement of the flexible diaphragm 320 that is caused by the pressure wave 330 can cause a change changes in C1 and C2 due to changes in the relative distance between the rigid backplate 310 and the flexible diaphragm 320 and the relative distance between the flexible diaphragm 320 and the portion of the substrate 210. Changes in C1 and C2 can cause a differential output signal that can be sensed by the operational amplifier 312. The differential output signal is representative of the pressure wave. The operational amplifier 312 can output a voltage 315 indicative of the differential output signal.

Figure 4:
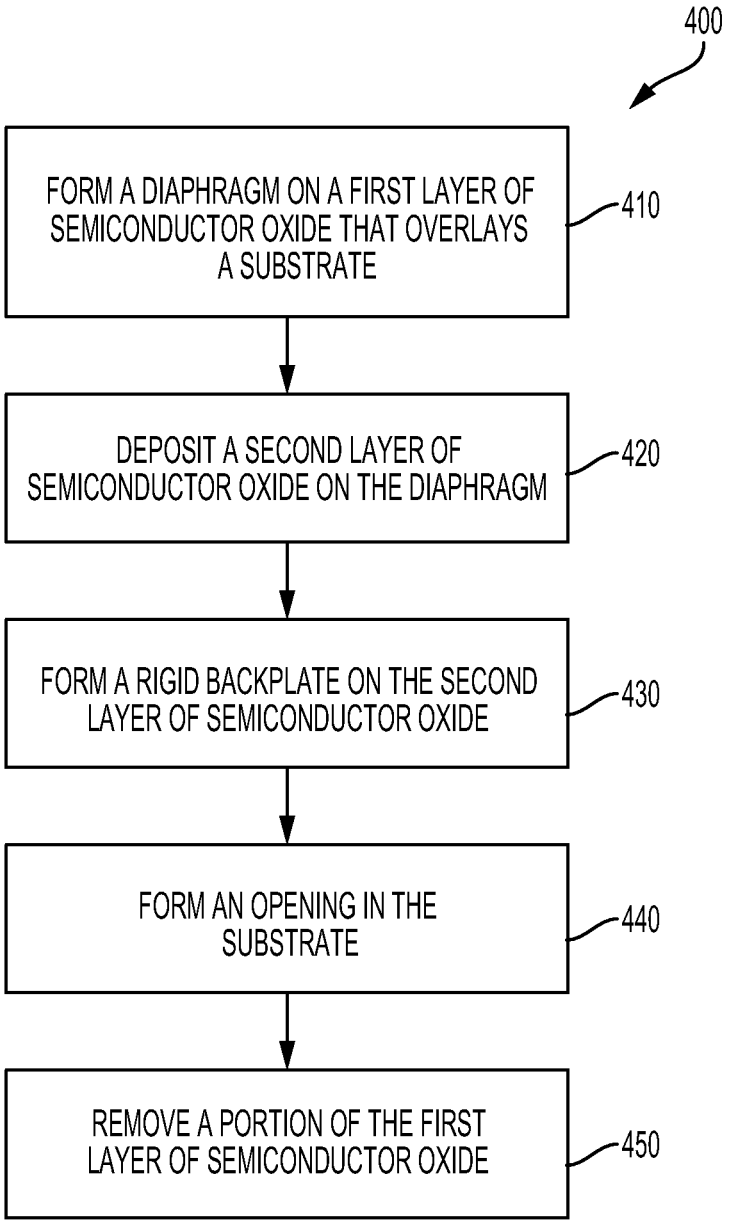
FIG. 4 illustrates examples of methods for fabricating a structure of a microelectromechanical microphone in accordance with one or more embodiments of the disclosure.

FIG. 4 presents a flowchart of an example method 400 for fabricating a structure of a microelectromechanical microphone in accordance with one or more embodiments of the disclosure. The substrate can include, for example, a semiconductor layer (e.g., a silicon slab) and/or a dielectric layer of dielectric material. At block 410, a diaphragm can be formed on a first layer of semiconductor oxide that overlays a substrate. As described herein, in one embodiment, the semiconductor oxide can include silicon oxide, and the substrate can be embodied in or can include a silicon wafer. It should be appreciated that the disclosure is not limited in that respect and essentially any combination of a semiconductor oxide and a semiconductor can be employed. Specifically, the semiconductor layer (e.g., layer 231) in the substrate (e.g., substrate 210) can include silicon (polycrystalline or crystalline), germanium, a semiconductor from group III, a semiconductor from group V, a semiconductor from group II, a semiconductor from group VI, or a combination thereof. In certain implementations, forming such a diaphragm can include micromachining the diaphragm to define openings on a circular arrangement, for example. In other implementations, forming the diaphragm can include etching the diaphragm to define a pattern of openings. The etching can include wet etching or dry etching, and it can be isotropic or anisotropic.

At block 420, a second layer of semiconductor oxide can be deposited on the diaphragm. The semiconductor oxide (e.g., silicon dioxide) in the second layer can be, for example, the same semiconductor oxide in the first layer. Although the semiconductor oxide in the second layer can be different from the semiconductor in the same layer, it should be appreciated that depositing the same semiconductor oxide can simplify this example method.

As described herein, the diaphragm can be formed to be sufficiently thin (e.g., about 0.1 μm to about 100 μm thick) in order to be flexible when not embedded within the first layer of semiconductor oxide and the second layer of semiconductor oxide. As such, the diaphragm can deform elastically in response to an impinging pressure wave, which can propagate an acoustic signal and/or an ultrasonic signal. At block 430, a rigid backplate can be formed on the second layer of semiconductor oxide. In one embodiment, forming the backplate can include forming a first via in the second layer of semiconductor oxide; depositing a layer of semiconductor on the second layer of semiconductor oxide, a portion of the layer of semiconductor covers the first via; and forming a pattern of openings in the layer of semiconductor. As described herein, the thickness of the rigid backplate can be about one or two orders of magnitude greater than the thickness of the diaphragm formed at block 410. In certain embodiments, the rigid backplate can be embodied in or can include silicon (polycrystalline or crystalline), germanium, a semiconductor from group III, a semiconductor from group V, a semiconductor from group II, a semiconductor from group VI, silicon oxide, or a combination thereof. Is such embodiments, as described herein, the semiconductor material that forms the rigid backplate can be or can include a portion that is doped (e.g., p-type doped) in order for the rigid backplate to form an electrode.

Figure 5:
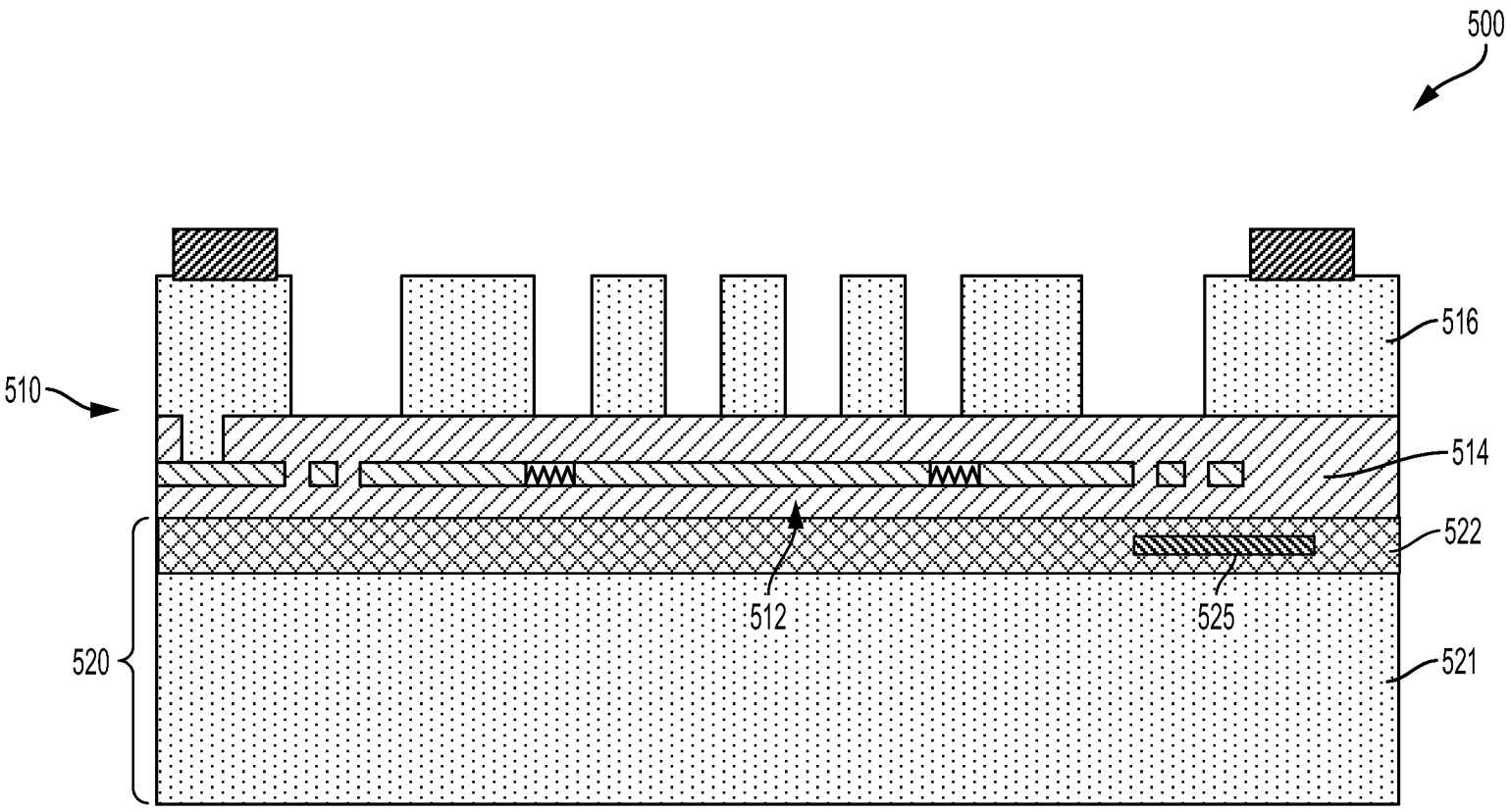
FIGS. 5-7 illustrate various stages of an example method for fabricating an microelectromechanical microphone in accordance with one or more embodiments of the disclosure.

Implementation of blocks 410-430 can result in the example structure 500 shown in FIG. 5. As illustrated, a layer 510 can overlay a substrate 520 and can form an interface therewith. The substrate 520 includes a layer 521 of semiconductor material and a layer 522 of dielectric material. The substrate 520 also can include an electrode 525 embedded in the layer 522 of dielectric material. It can be appreciated that the electrode 525 can embody the electrode 235. The layer 510 can include a diaphragm 512 embedded in a semiconductor oxide region 514, which can result from deposition of the first and second layers of semiconductor oxide at block 410 and 420. The layer 510 also includes a rigid backplate 516.

Figure 6:
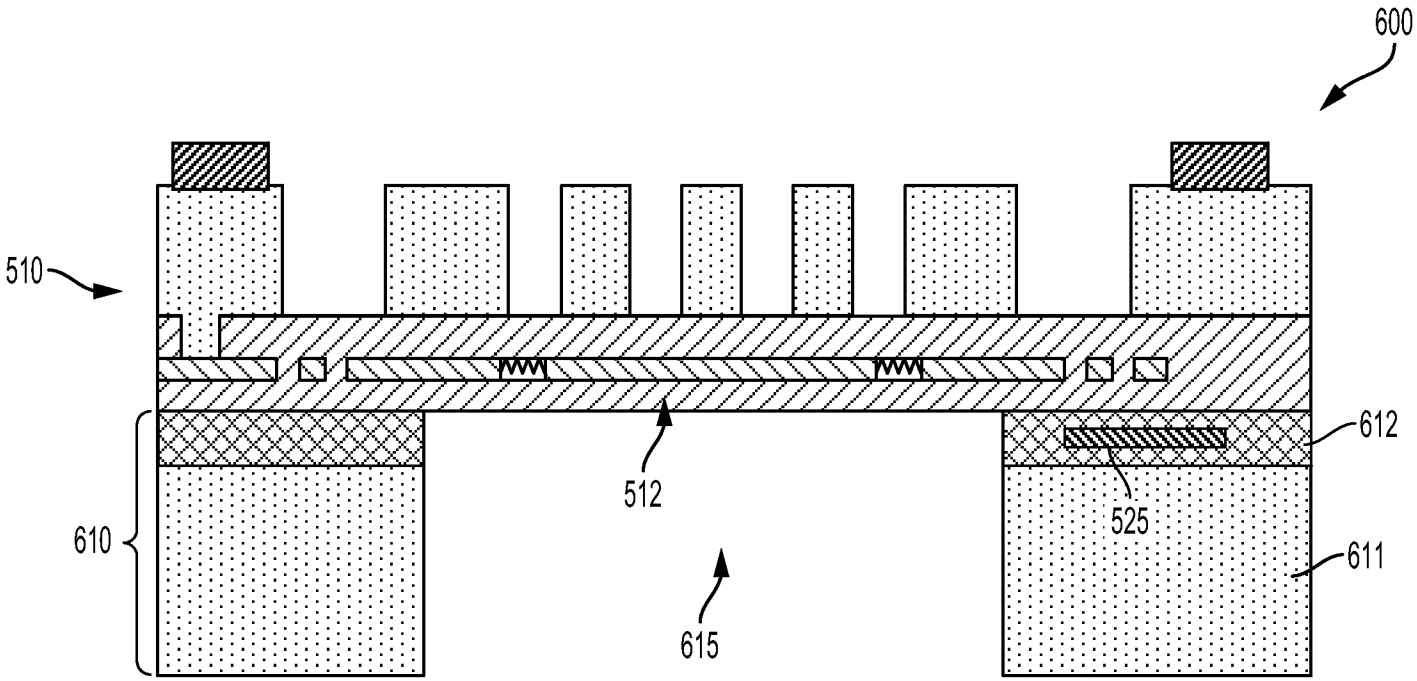

With further reference to FIG. 4, at block 440, an opening can be formed in the substrate. The substrate can include, in certain embodiments, a layer of semiconductor material and a layer of dielectric material, and thus, the opening can be formed through such layers. In certain implementations, the opening can be formed by etching a portion of the substrate. In one example, the etching can be anisotropic and can include wet etching or dry etching. In another example, the etching can be isotropic and can include wet etching or dry etching. Depending on intended size, the opening can be formed by machining or otherwise mechanically removing a portion of the semiconductor substrate. An example of a structure 600 resulting from implementation of block 440 is illustrated in FIG. 6. The structure 600 includes the layer 510 and a substrate 610 that defines an opening 615. The substrate 610 includes a layer 611 of semiconductor material and a layer 612 of dielectric material. The substrate 610 also includes an electrode 525 embedded in the layer 522 of dielectric material. It can be appreciated that the electrode 525 can embody the electrode 235.

Figure 7:
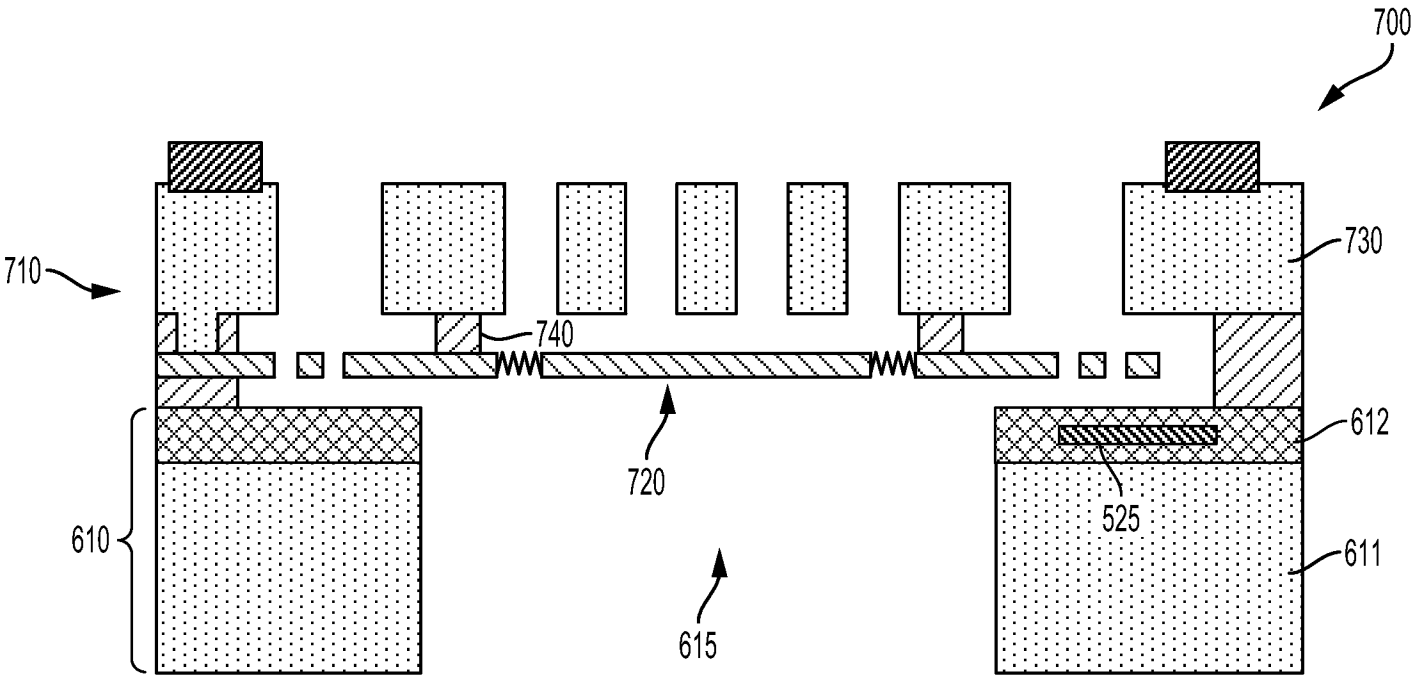

At block 450, a portion of the first and second layers of semiconductor oxide can be removed. The amount of semiconductor oxide that is removed can be referred to as sacrificial oxide. In certain implementations, removing such a portion of sacrificial oxide can include etching the portion of the first layer of semiconductor oxide and the portion of the second layer of semiconductor oxide. Similar to block 440, in one example, the etching can be anisotropic and can include wet etching or dry etching. In another example, the etching can be isotropic and can include wet etching or dry etching. An example of a structure 600 resulting from implementation of block 450 is illustrated in FIG. 7. The structure 700 includes the substrate 610, defining an opening 615, and a layer 710 including a diaphragm 720, a backplate 730, and one or more dielectric members 740 that mechanically couple the diaphragm 720 and the backplate 730.

Figure 8:
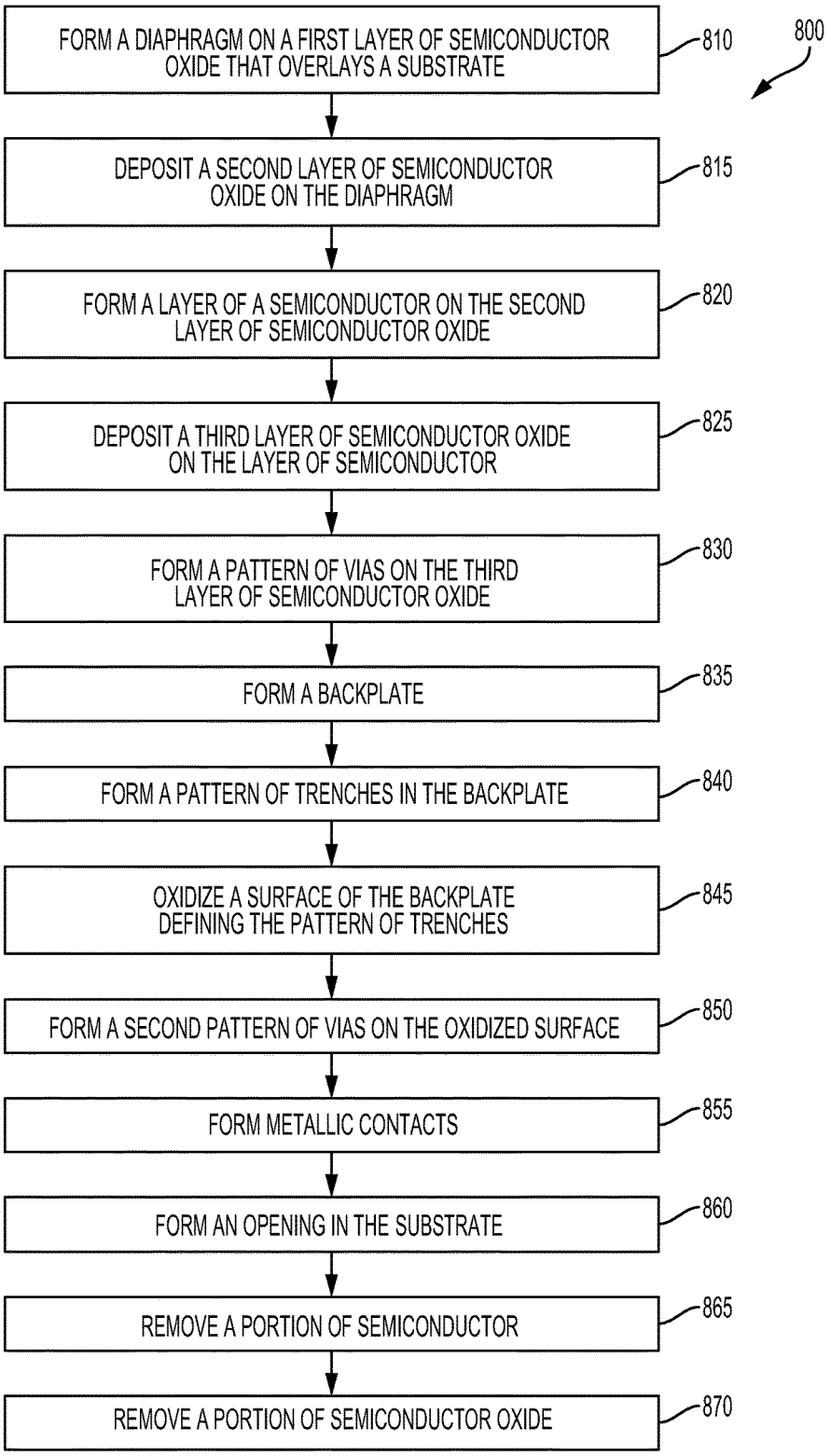
FIG. 8 illustrate an example of a method for fabricating a structure of a microelectromechanical microphone in accordance with one or more embodiments of the disclosure.

FIG. 8 presents a flowchart of an example method 800 for fabricating a structure of a microelectromechanical microphone in accordance with one or more embodiments of the disclosure. Blocks of the example method are illustrated with reference with FIGS. 9-18, which present various fabrication stages of the structure.

With reference to FIG. 8, at block 810 a diaphragm can be formed on a first layer of semiconductor oxide that overlays a substrate. At block 815, a second layer of semiconductor oxide can be deposited on the diaphragm. Each of these blocks can be implemented in substantially the same manner in which each of blocks 410 and 420 can be implemented.

At block 820, a layer of a semiconductor can be formed on the second layer of semiconductor oxide. Such a layer can define multiple cavities and can be formed by depositing the semiconductor on the diaphragm and at least a portion of a surface of the first layer of semiconductor oxide. The semiconductor can be deposited in a number of ways, including sputtering, chemical vapor deposition (CVD), molecular beam epitaxy (MBE), a combination thereof, or the like. The layer of semiconductor can include silicon (e.g., polycrystalline silicon or single-crystalline silicon), germanium, or an alloy of silicon and germanium. In certain embodiments, the layer of semiconductor can include multiple sub-layers, each including a semiconductor material. In one embodiment, forming the layer of the semiconductor can include depositing an amount of polycrystalline silicon on the second layer of semiconductor oxide, and etching a portion of the amount of polycrystalline silicon to form the multiple cavities.

At block 825, a third layer of semiconductor oxide can be deposited on the layer of semiconductor. The semiconductor oxide can be deposited in a number of ways, including sputtering, CVD, MBE, a combination thereof, or the like. It can be appreciated that the third layer of semiconductor oxide also can cover or otherwise coat a portion of a surface of the second layer of semiconductor oxide. In one example, as described herein, the semiconductor oxide (e.g., silicon dioxide) of the third layer can be the same type as the semiconductor oxide of the second layer. Regardless of the type of semiconductor oxide in the second and third layers, the layer of semiconductor that can be formed at block 820 can contained within a dielectric material. The third layer of semiconductor oxide can be deposited conformally, and thus, the cavities defined by the layer of semiconductor can be filled by the dielectric material.

Figure 9:
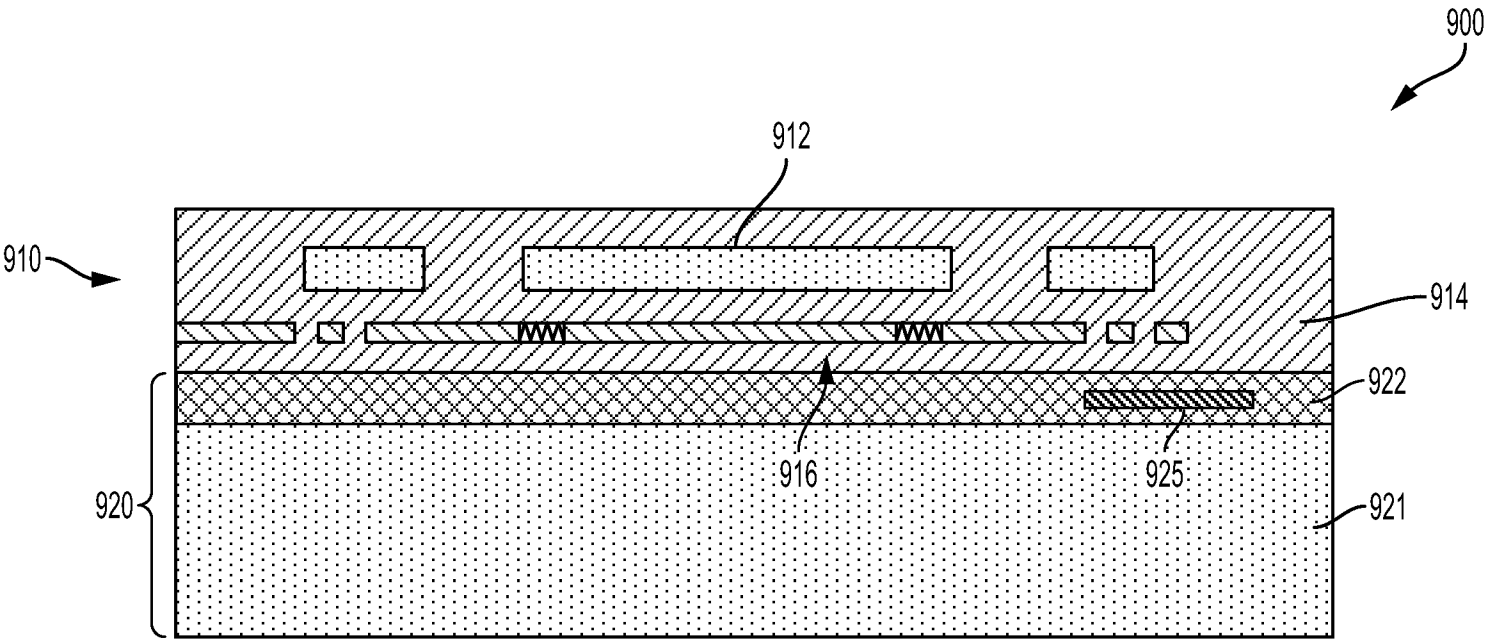
FIGS. 9-18 illustrate various stages of an example method for fabricating a microelectromechanical microphone in accordance with one or more embodiments of the disclosure.

Implementation of blocks 810 through 825 can result on the example structure 900 illustrated in FIG. 9. As illustrated, a layer 910 can be overlaid onto a surface of a substrate 920. The substrate 920 includes a layer 921 of semiconductor material, e.g., a silicon slab or wafer) and a layer 922 of dielectric material. The substrate 920 also includes an electrically isolated electrode 925 embedded in the layer 922 of dielectric material. It can be appreciated that the electrode 925 can embody the electrode 235. The layer 910 includes a diaphragm 916, which can be formed at block 810, and a layer 912 formed from a semiconductor at block 820, for example. In the layer 910, the layer 912 and the diaphragm 916 are embedded within a slab 914 of semiconductor oxide. The slab 914 can include the first, second, and third layer of semiconductor oxide.

Figure 10:
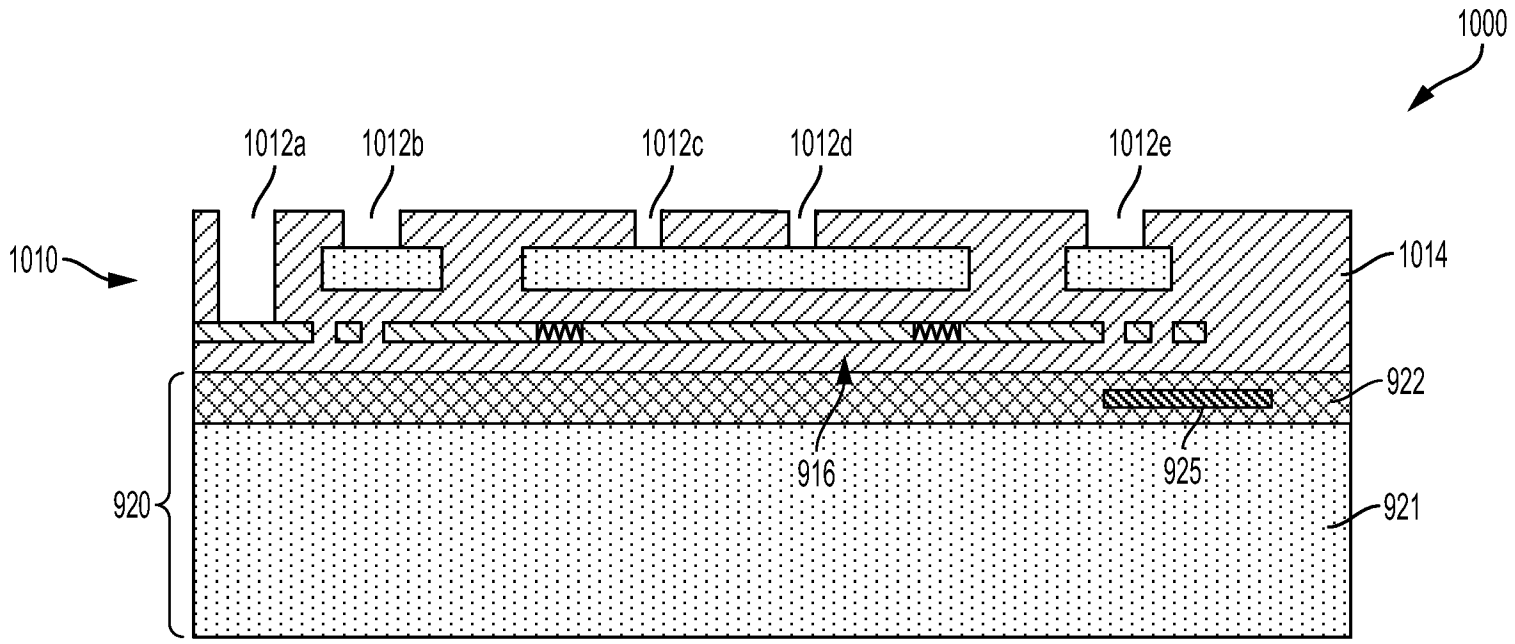

With further reference to FIG. 8, at block 830, a pattern of vias can be formed on the third layer of semiconductor oxide. To that end, a surface (e.g., a top planar surface) of the third layer of semiconductor oxide can be masked according to the pattern of vias. In addition, the resulting masked layer can be etched to remove a portion of the semiconductor oxide (e.g., silicon dioxide) of the third layer. The etching of the masked layer can be isotropic or anisotropic, and reactant(s) utilized in the etching may react nearly exclusively with the semiconductor oxide in the third layer. As an illustration, FIG. 10 presents an example structure 1000 obtained by implementing block 830. As shown, a layer 1010 can include a layer 1014 that defines cavities that embody the pattern of vias. In view that the etching may be configured, for example, to remove the semiconductor oxide that forms the third and second layers of semiconductor oxide, a larger cavity may be formed in a region of the layer 1010 in which a semiconductor is not present. As such, cavity 1012*a* can have a depth greater than the depth of each of cavities 1012*b*-1012*e*. In addition, a surface of the diaphragm 916 can form an end of the cavity 1012*a*. Respective surfaces of the layer of semiconductor from respective ends of the cavities 1012*b*-1012*e*.

Figure 11:
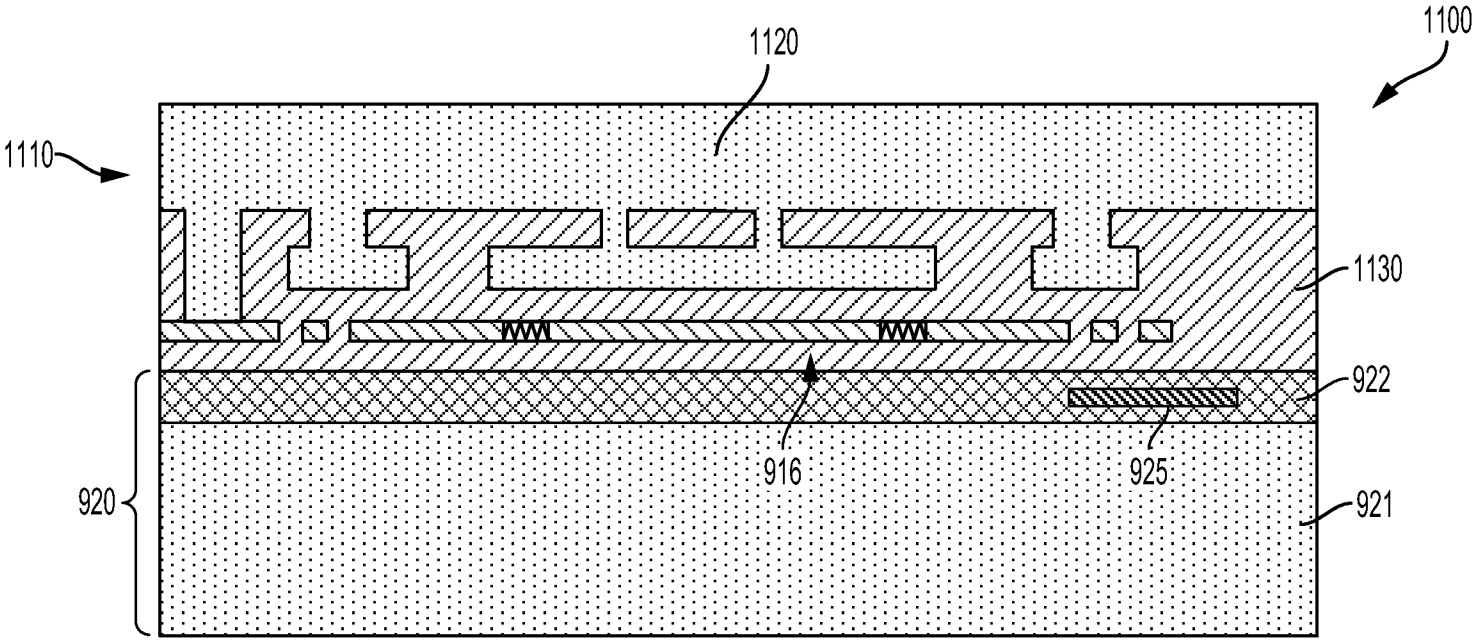

At block 835 in FIG. 8, a backplate can be formed. To that end, in certain embodiments, a layer of a second semiconductor can be conformally deposited onto a surface defined by the cavities 812*a*-812*e* and a surface of the third layer of semiconductor oxide. The coverage of the layer of the second semiconductor can fill the cavities 812*a*-812*e* and can form a plate atop of the covered cavities. The second semiconductor can be deposited in a number of ways, including sputtering, CVD, MBE, a combination thereof, or the like. While the second semiconductor can be different from the semiconductor of the layer formed at block 825, it should be appreciated that forming the backplate from the same semiconductor as the semiconductor deposited at block 825 can simplify this example method. FIG. 11 illustrates an example structure 1100 resulting from implementation of block 835. In the example structure 1100, the second semiconductor is the same as the semiconductor deposited at block 825. Accordingly, a layer 1110 is formed, including a layer 1120 of semiconductor (e.g., silicon) and a layer 1130 of semiconductor oxide. As shown, the layer 1130 includes the diaphragm 916. It should be appreciated that the disclosure is not limited to second semiconductor being the same as the first semiconductor, and these semiconductors can be different.

Figure 12:
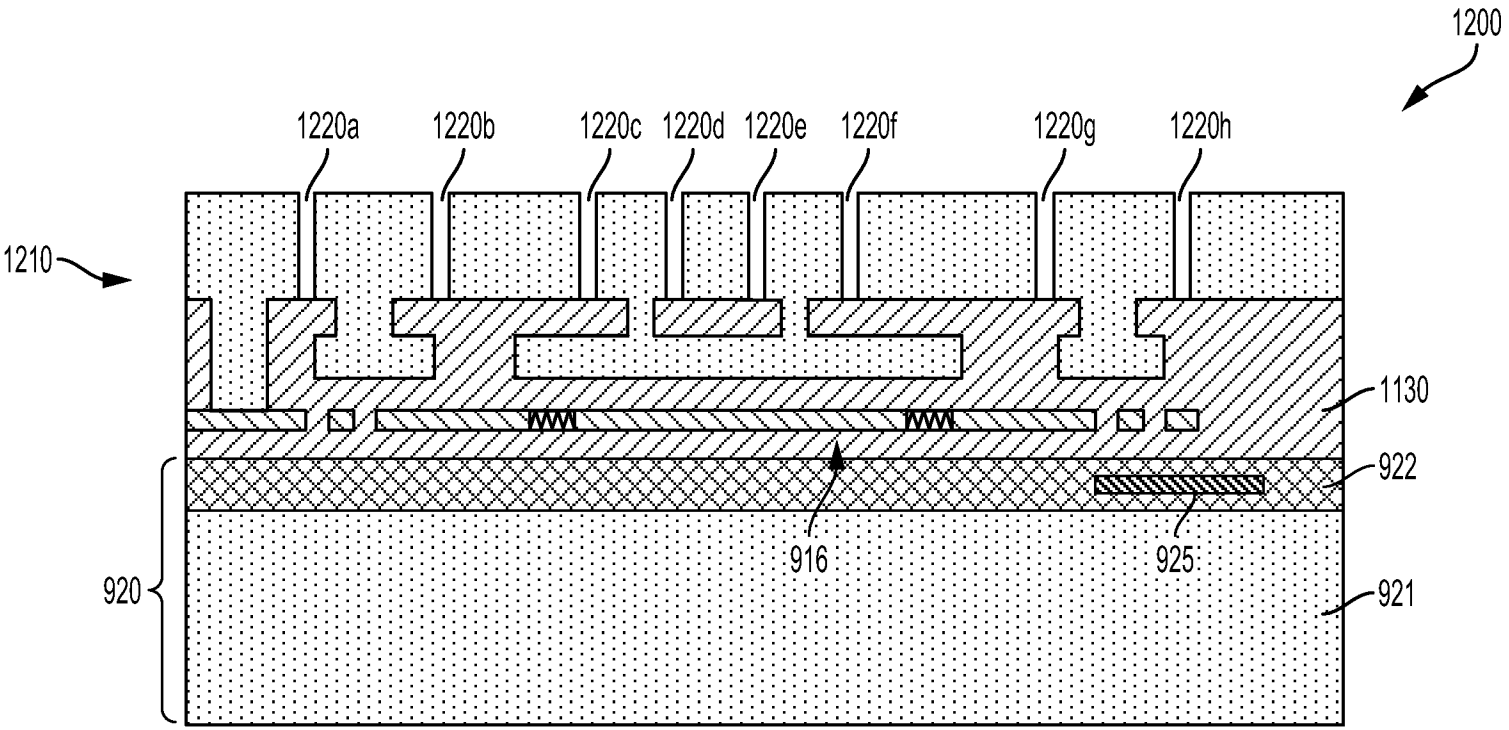

Continuing with FIG. 8, at block 840, a pattern of trenches can be formed in the backplate. Specifically, in one example, the backplate can be etched selectively in order to remove a portion of the second semiconductor that forms the backplate and to not react with the semiconductor oxide that forms the third layer of semiconductor oxide. FIG. 12 illustrates an example structure 1200 that can result from implementation of block 840. Such an example structure includes a layer 1210 including a layer that defines trenches 1220*a*-1220*h* which can be arranged according to the pattern.

Figure 13:
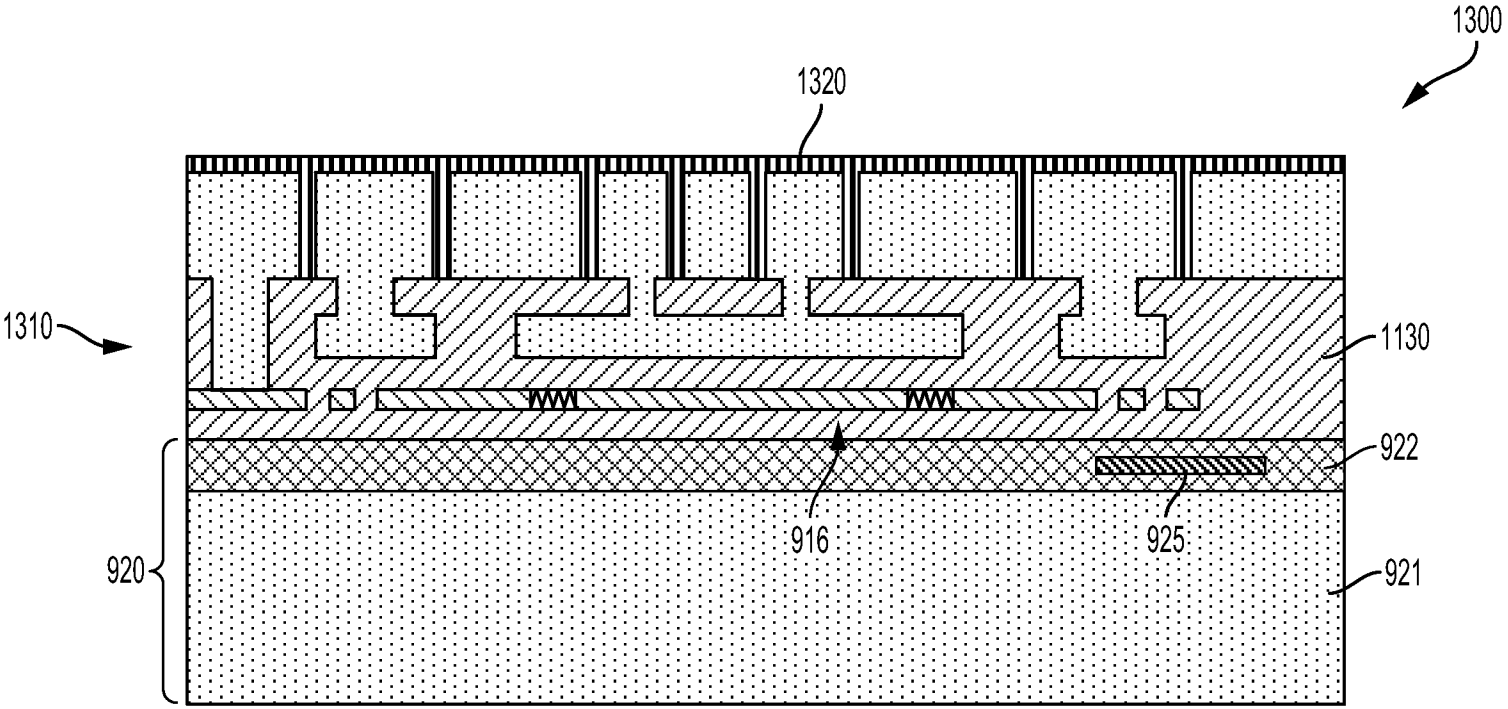

At block 845, a surface of the backplate defining the pattern of trenches can be oxidized. To that end, an oxide can be deposited conformally onto such a surface, covering the trenches and forming a layer of oxide that covers the backplate. The oxide can be deposited in a number of ways, including sputtering, CVD, or the like. FIG. 13 illustrates an example structure 1300 that can result from implementation of block 845. Such an example structure includes a layer 1310 including a layer of oxide 1320 that results from conformally coating the pattern of trenches with the oxide (e.g., silicon dioxide).

Figure 14:
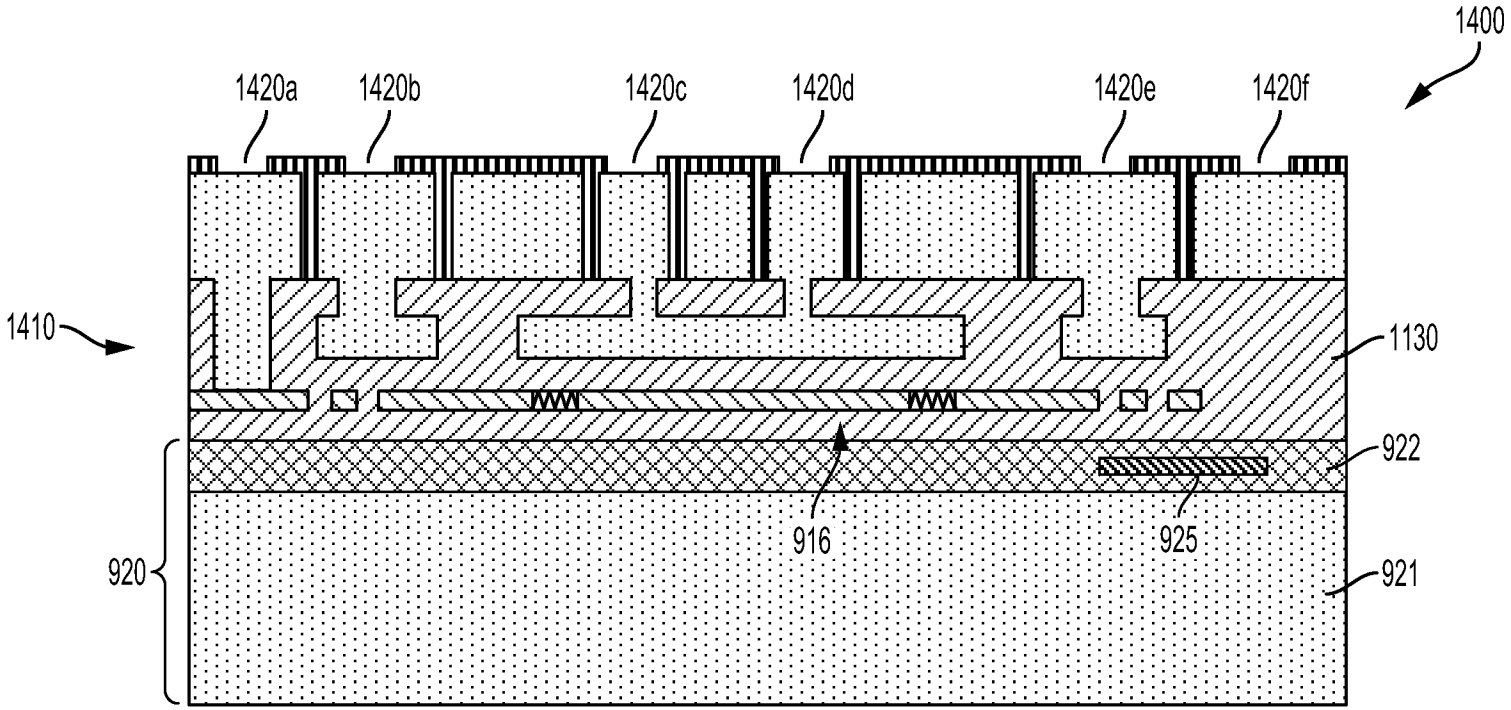

At block 850, a second pattern of vias can be formed on the oxidized surface—e.g., the layer of oxide that covers that backplate. Similar to the formation of the pattern of vias at block 830, in one implementation, the second pattern of vias can be formed by etching a portion of the layer of oxide that covers the backplate. As an illustration, FIG. 14 presents an example structure 1400 that can result from implementation of block 850. A structure 1410 defines cavities 1420*a*-1420*f* that can be arranged according to a pattern. The cavities 1420*a*-1420*f* can embody the second patter of vias.

Figure 15:
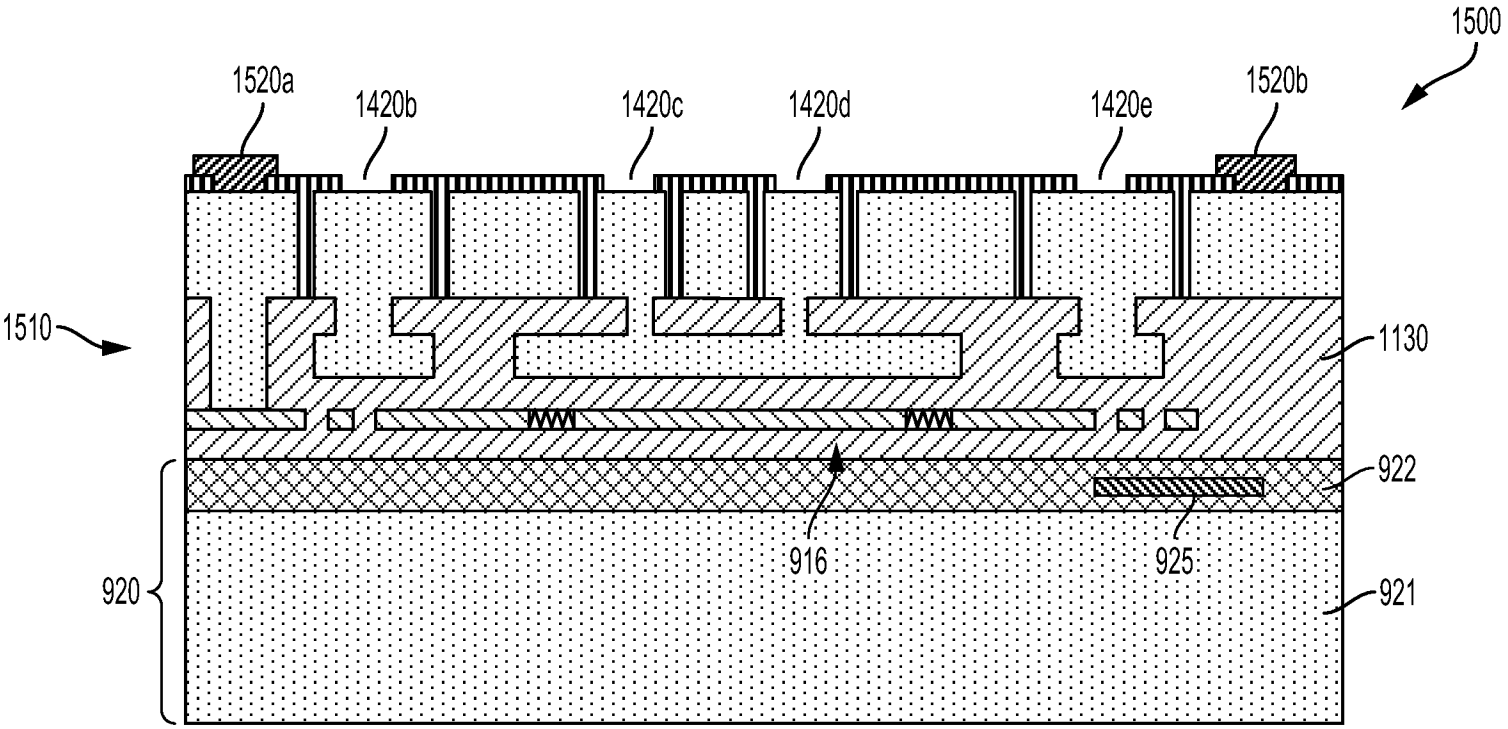

At block 855, metallic contacts can be formed at respective vias in the second pattern of vias. As described herein, a metallic contact can be formed by depositing a metal onto a vias in the second pattern of vias. For example, the metal can be embodied in or can include gold, silver, platinum, titanium, other types of noble metal, or an alloy thereof. In addition or in another example, the metal can be embodied in or can include aluminum, copper, tungsten, chromium, or an alloy thereof. As an illustration, FIG. 15 presents an example structure 1500 that can result from implementation of block 855. A structure 1510 includes two metal contacts: metal pad 1520*a* and metal pad 1520*b*. Such metal contacts can embody, respectively, the metal pad 140*a* and metal pad 140*b*.

Figure 16:
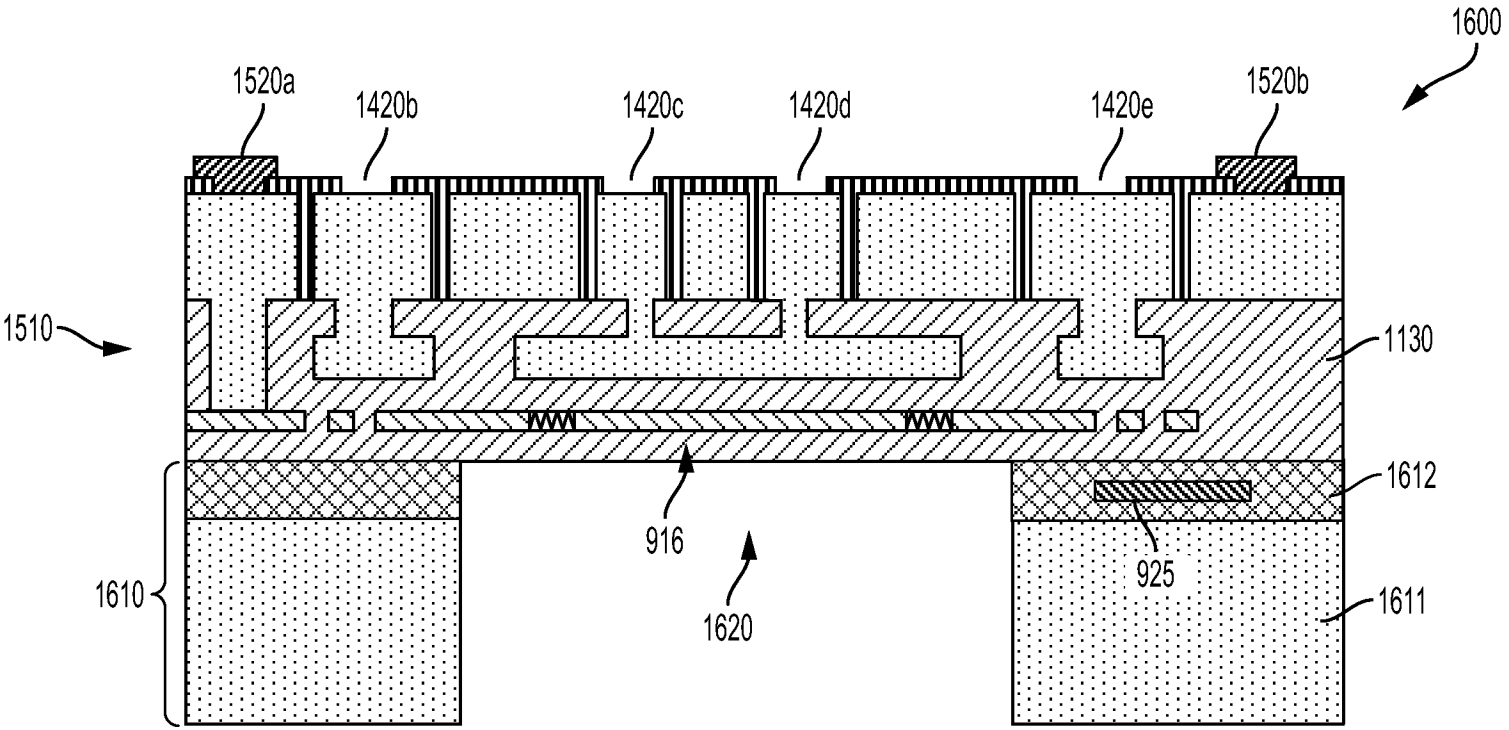

At block 860, an opening in the substrate can be formed. For example, as described herein, the substrate can include a layer of semiconductor material and a layer of dielectric material. Thus, implementation of block 860 can include, for example, removal of a portion of each of such layers in order to form the opening. The opening can be referred to an acoustic port and can be configured to receive an acoustic wave or other type of pressure wave. In certain implementations, the layer of semiconductor material can be etched and/or machined in order to remove an amount of the layer of semiconductor (e.g., silicon, germanium, or an alloy thereof). Similarly, the layer of dielectric material also can be etched and/or machined in order to remove an amount thereof. FIG. 16 presents an example structure 1600 that can result from implementation of block 860. Removal of the portion of the layer of semiconductor can result in a substrate 1610 that defines an opening 1620. The substrate 1610 includes a layer 1611 of semiconductor material and a layer 1612 of dielectric material, each of such layers defining a portion of the opening 1620. The removal of material at block 860 may not remove the electrode 925 or a portion thereof and, thus, the substrate 1620 includes the electrically isolated electrode 925 embedded in the layer 1612 of dielectric material.

Figure 17:
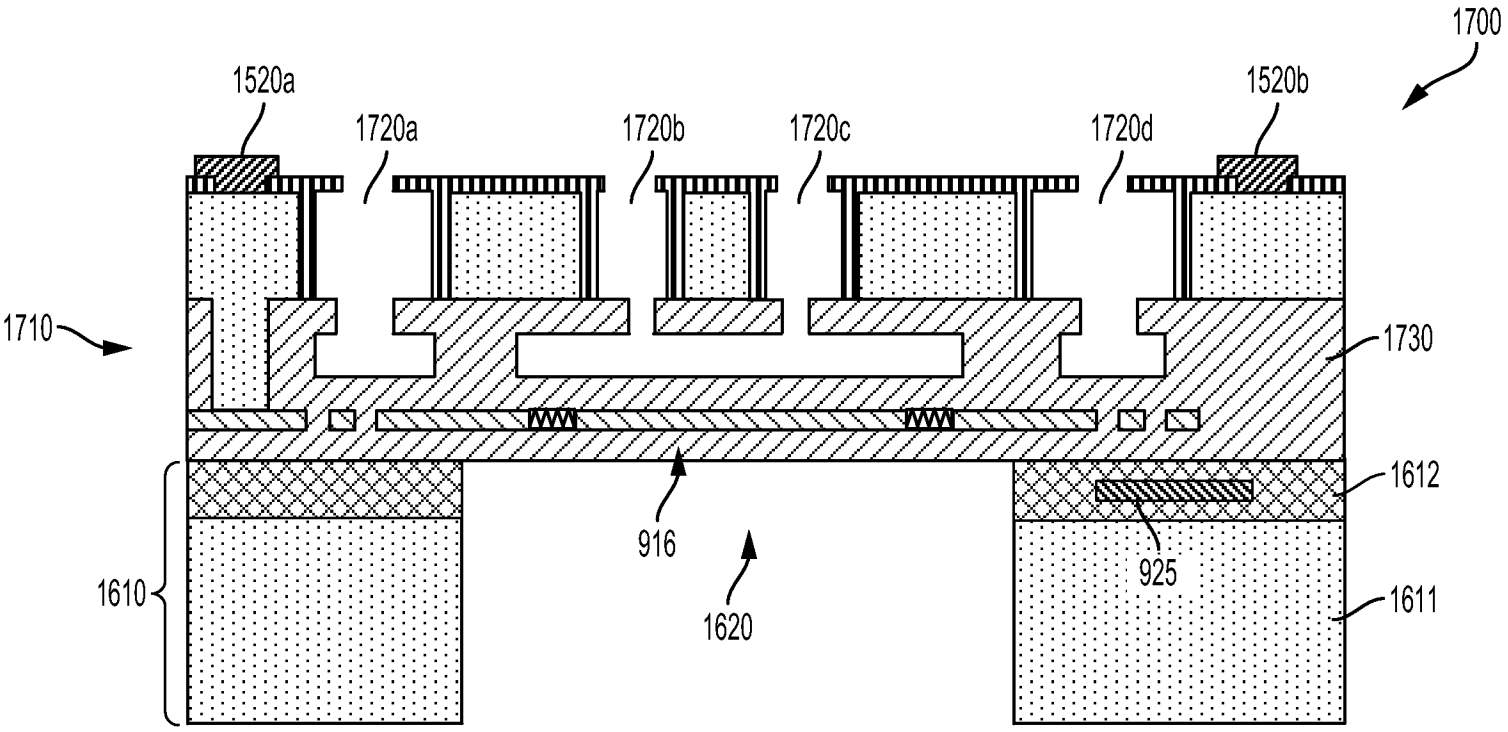

At block 865, a portion of semiconductor is removed. As such, the semiconductor that is removed can be referred to as sacrificial semiconductor material. FIG. 17 presents an example structure 1700 that can result from implementation of block 865. Specifically, the example structure 1700 can include a layer 1710 defining cavities 1720*a*-1720*d*. Some of the cavities, e.g., cavity 1720*b* and cavity 1720*c* can extend into an inner portion of the layer 1710, resulting in a single cavity. The layer 1710 also includes a layer 1730 of semiconductor oxide. As illustrated, each of the cavities extend into the layer 1730.

Figure 18:
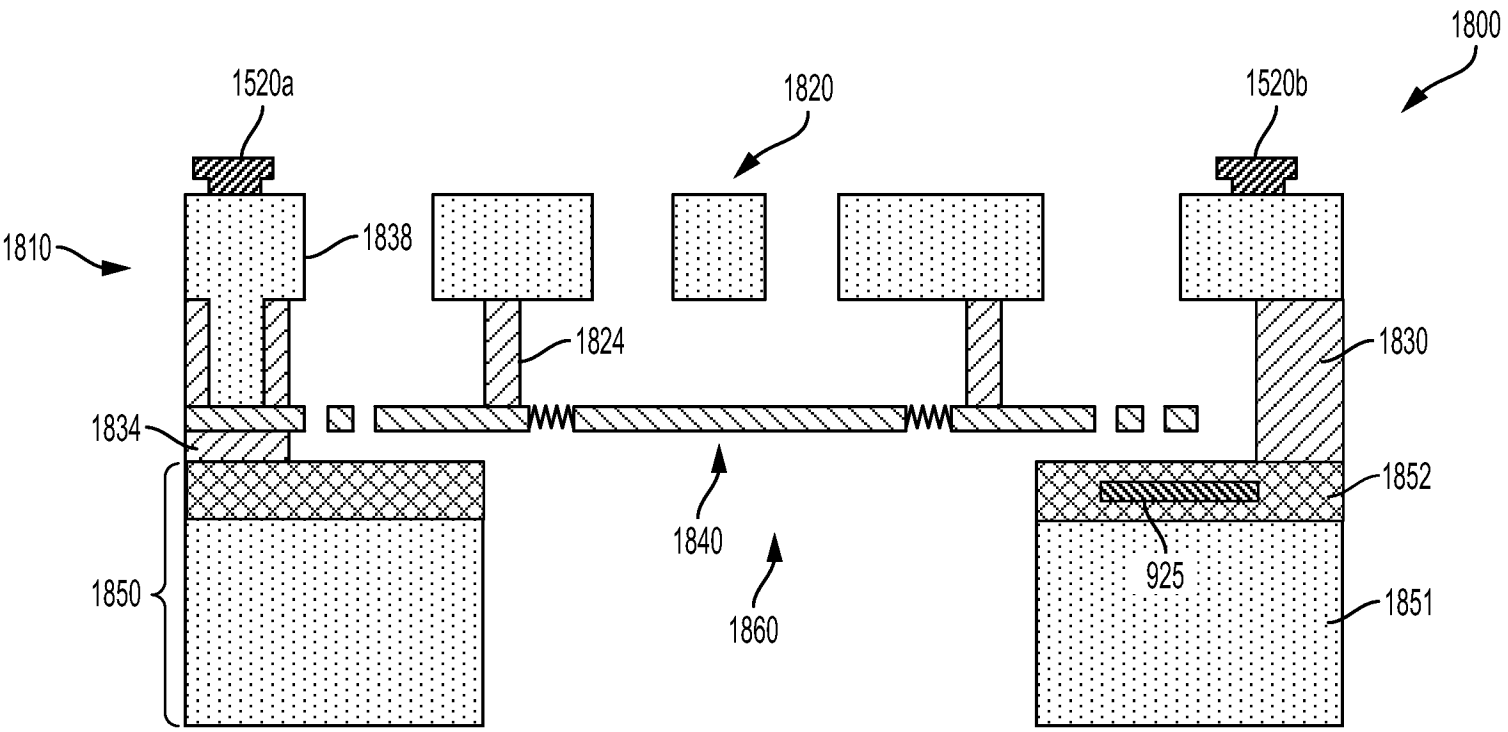

At block 870, a portion of semiconductor oxide is removed. As such, the semiconductor that is removed can be referred to as sacrificial semiconductor oxide material. FIG. 18 presents an example structure 1800 that can result from implementation of block 870. The example structure 1800 includes a layer 1810 that includes a rigid plate 1820 and a movable plate 1840. The rigid plate 1820 can be mechanically coupled (e.g., rigidly coupled) to the diaphragm 1840 via a dielectric member 1824. It can be appreciated that the dielectric member 1824 can embody or can include the dielectric member 265. In addition, a dielectric member 1830 can electrically isolate the rigid plate 1820 from a substrate 1850, which defines an opening 1860. The dielectric member 1830 also mechanically couples the rigid plate 1820 to the substrate 1850, and thus, the dielectric member 1830 can provide mechanical support to the rigid plate 1820, anchoring the rigid plate 1820 to the substrate 1850. A dielectric member 1834 electrically isolates the movable plate 1840 (or movable diaphragm 1840) from the substrate 1850. The dielectric member 1834 also mechanically couples the diaphragm 1840 to the substrate 1850. Accordingly, in one example, the dielectric member 1834 also can provide mechanical support to the movable plate 1840, anchoring the movable plate 1840 to the substrate 1850. The layer 1810 also includes a member 1838 that can electrically couple the metal pad 1520*a* and the diaphragm 1840. The substrate 1850 is substantially the same to the substrate 1610 and, as such, it includes a semiconductor layer 1851, a dielectric layer 1852, and the electrically isolated electrode 925.

Figure 19A:
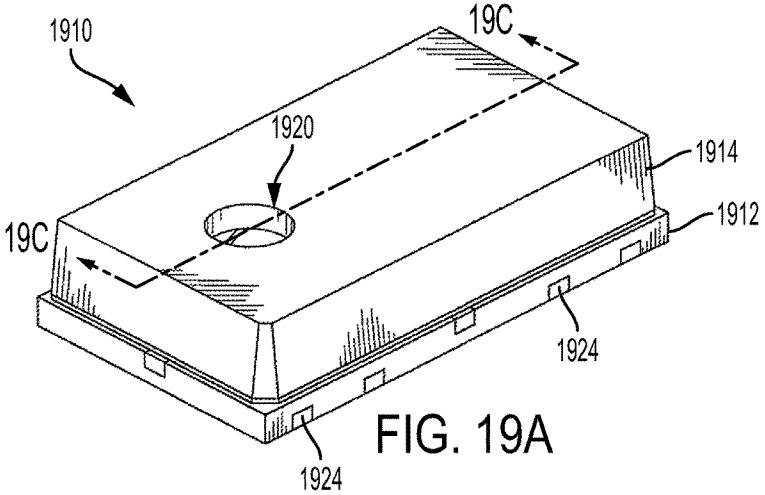
FIG. 19A illustrates a top perspective view of a packaged microphone having a microelectromechanical microphone die in accordance with one or more embodiments of the disclosure.

The microelectromechanical microphones having a stationary portion in accordance with this disclosure can be packaged for operation within an electronic device or other types of appliances. As an illustration, FIG. 19A presents a top, perspective view of a packaged microphone 1910 that can include a microelectromechanical microphone die in accordance with one or more embodiments of this disclosure (such as the microelectromechanical microphone die 100 shown in FIG. 1 and discussed herein). In addition, FIG. 19B presents a bottom, perspective view of the packaged microphone 1910.

As illustrated, the packaged microphone 1910 has a package base 1912 and a lid 1914 that form an interior chamber or housing that contains a microelectromechanical microphone chipset 1916. In addition or in other embodiments, such a chamber can include a separate microphone circuit chipset 1918. The microelectromechanical microphone chipsets 1916 and 1918 are depicted in FIGS. 19C and 19D and are discussed hereinafter. In the illustrated embodiment, the lid 1914 is a cavity-type lid, which has four walls extending generally orthogonally from a top, interior face to form a cavity. In one example, the lid 1914 can be formed from metal or other conductive material to shield the microelectromechanical microphone chipset 1916 from electromagnetic interference. The lid 1914 secures to the top face of the substantially flat package base 1912 to form the interior chamber.

As illustrated, the lid 1914 can have an audio input port 1920 that is configured to receive audio signals (e.g., audible signals and/or ultrasonic signals) and can permit such signals to ingress into the chamber formed by the package base 1912 and the lid 1914. In additional or alternative embodiments, the audio port 1920 can be placed at another location. For example, the audio port 1920 can be placed at the package base 1912. For another example, the audio port 1912 can be place at one of the side walls of the lid 1914. Regardless of the location of the audio port 1920, audio signals entering the interior chamber can interact with the microelectromechanical microphone chipset 1916 to produce an electrical signal representative of at least a portion of the received audio signals. With additional processing via external components (such as a speaker and accompanying circuitry), the electrical signal can produce an output audible signal corresponding to an input audible signal contained in the received audio signals.

Figure 19B:
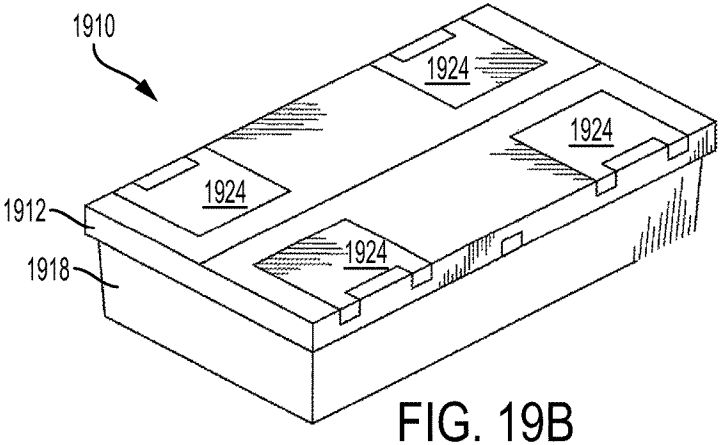
FIG. 19B illustrates a bottom perspective view of the packaged microphone shown in FIG. 19A.
Figure 19C:
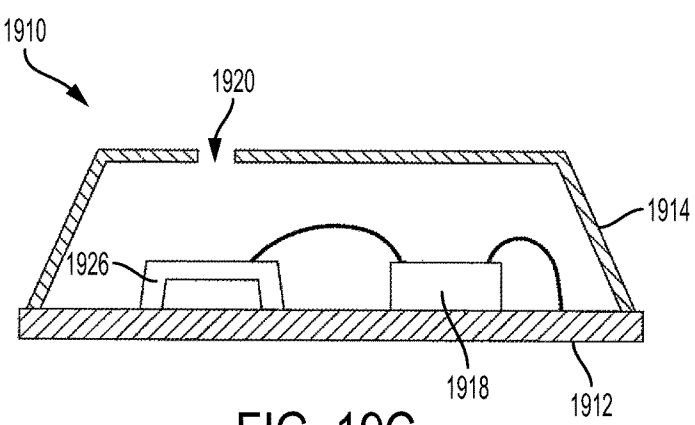
FIG. 19C illustrates a cross-sectional view of the packaged microphone shown in FIG. 19A.
Figure 19D:
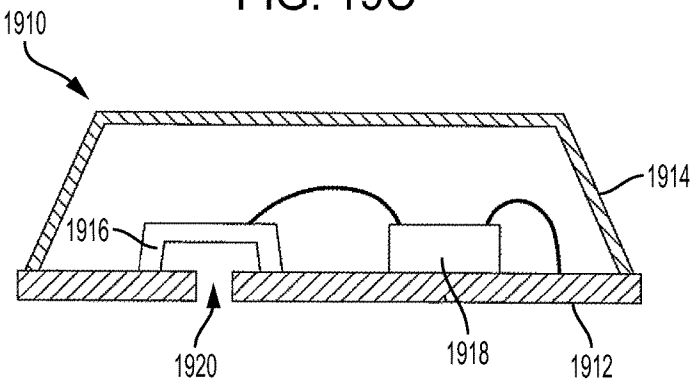
FIG. 19D illustrates a cross-sectional view of another example of a packaged microphone having a microelectromechanical microphone die in accordance with one or more embodiments of the disclosure.

FIG. 19B presents an example of a bottom face 1922 of the package base 1912. As illustrated, the bottom face 1922 has four contacts 1924 for electrically (and physically, in many use cases) connecting the microelectromechanical microphone chipset 1916 with a substrate, such as a printed circuit board or other electrical interconnect apparatus. While four contacts 1924 are illustrated, it should be appreciated that the disclosure is not limited in this respect and other number of contacts can be implemented in the bottom face 1922. The packaged microphone 1910 can be used in any of a wide variety of applications. For example, the packaged microphone 1910 can be used with mobile telephones, land-line telephones, computer devices, video games, hearing aids, hearing instruments, biometric security systems, two-way radios, public announcement systems, and other devices that convert mechanical energy associated with an acoustic wave to electrical energy. In a particular, yet not exclusive, implementation, the packaged microphone 1910 can be used within a speaker to produce audible signals from electrical signals.

In certain embodiments, the package base 1912 shown in FIGS. 19A and 19B can be embodied in or can contain a printed circuit board material, such as FR-4, or a premolded, leadframe-type package (also referred to as a "premolded package"). Other embodiments may use or otherwise leverage different package types, such as ceramic cavity packages. Therefore, it should be appreciated that this disclosure is not limited to a specific type of package.

FIG. 19C illustrates a cross-sectional view of the packaged microphone 1910 across line 19C-19C in FIG. 19A. As illustrated and discussed herein, the lid 1914 and package base 1912 form an internal chamber or housing that contains a microelectromechanical microphone chipset 16 and a microphone circuit chipset 1918 (also referred to as "microphone circuitry 1918") used to control and/or drive the microelectromechanical microphone chipset 1916. In certain embodiments, electronics can be implemented as a second, stand-alone integrated circuit, such as an application specific integrated circuit (e.g., an "ASIC die 1918") or a field programmable gate array (e.g., "FPGA die 1918"). It should be appreciated that, in certain embodiments, the microelectromechanical microphone chipset 1916 and the microphone circuit chipset 1918 can be formed on a single die.

Adhesive or another type of fastening mechanism can secure or otherwise mechanically couple the microelectromechanical microphone chipset 1916 and the microphone circuit chipset 1918 to the package base 1912. Wirebonds or other type of electrical conduits can electrically connect the microelectromechanical microphone chipset 1916 and microelectromechanical microphone circuit chipset 1918 to contact pads (not shown) on the interior of the package base 1912.

While FIGS. 19A-19C illustrate a top-port packaged microphone design, certain embodiments can position the audio input port 1920 at other locations, such as through the package base 1912. For instance, FIG. 19D illustrates a cross-sectional view of another example of a packaged microphone 1910 where the microelectromechanical microphone chipset 1916 covers the audio input port 1920, thereby producing a large back volume. In other embodiments, the microelectromechanical microphone chipset 1916 can be placed so that it does not cover the audio input port 1920 through the package base 1912.

It should be appreciated that the present disclosure is not limited with respect to the packaged microphone 1910 illustrated in FIGS. 19A-19D. Rather, discussion of a specific packaged microphone is for merely for illustrative purposes. As such, other microphone packages including a microelectromechanical microphone having a stationary region in accordance with the disclosure are contemplated herein.

In the present specification, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in this specification and annexed drawings should generally be construed to mean "one or more" unless specified otherwise or clear from context to be directed to a singular form.

In addition, the terms "example" and "such as" are utilized herein to mean serving as an instance or illustration. Any embodiment or design described herein as an "example" or referred to in connection with a "such as" clause is not necessarily to be construed as preferred or advantageous over other embodiments or designs. Rather, use of the terms "example" or "such as" is intended to present concepts in a concrete fashion. The terms "first," "second," "third," and so forth, as used in the claims and description, unless otherwise clear by context, is for clarity only and doesn't necessarily indicate or imply any order in time.

What has been described above includes examples of one or more embodiments of the disclosure. It is, of course, not possible to describe every conceivable combination of components or methodologies for purposes of describing these examples, and it can be recognized that many further combinations and permutations of the present embodiments are possible. Accordingly, the embodiments disclosed and/or claimed herein are intended to embrace all such alterations, modifications and variations that fall within the spirit and scope of the detailed description and the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A microelectromechanical microphone system, comprising:

a substrate that defines an opening configured to receive an acoustic wave;

a movable diaphragm having a first portion mechanically coupled to the substrate and a second portion that is flexibly coupled to the first portion, wherein the movable diaphragm and the substrate form a first capacitor having a first capacitance based on a displacement of the movable diaphragm caused by the acoustic wave; and a backplate mechanically coupled to the movable diaphragm via one or more dielectric members, each of the one or more dielectric members extends between a surface of the backplate and a surface of the movable diaphragm, wherein the backplate and the movable diaphragm form a second capacitor having a second capacitance based on the displacement of the movable diaphragm, and wherein the first capacitor is measured on a first side of the movable diaphragm and the second capacitor is measured on a second side of the movable diaphragm, the first side being opposite the second side.

2. The microelectromechanical microphone system of claim 1, wherein the movable diaphragm defines openings.

3. The microelectromechanical microphone system of claim 1, wherein a surface of the first portion is in contact with a dielectric layer overlaying the substrate.

4. The microelectromechanical microphone system of claim 1, wherein each of the one or more dielectric members comprises a semiconductor oxide.

5. The microelectromechanical microphone system of claim 1, wherein the substrate comprises a semiconductor.

6. The microelectromechanical microphone system of claim 1, wherein the diaphragm comprises polycrystalline silicon or a doped semiconductor.

7. The microelectromechanical microphone system of claim 1, wherein the backplate comprises silicon, germanium, a semiconductor from group III, a semiconductor from group V, a semiconductor from group II, a semiconductor from group VI, silicon oxide, polycrystalline silicon, or a combination thereof.

8. A device, comprising:

a microelectromechanical microphone including:

a substrate that defines an opening configured to receive an acoustic wave;

a movable diaphragm having a first portion mechanically coupled to the substrate and a second portion that is flexibly coupled to the first portion, wherein the movable diaphragm and the substrate form a first capacitor having a first capacitance based on a displacement of the movable diaphragm caused by the acoustic wave; and a backplate mechanically coupled to the movable diaphragm via one or more dielectric members, each of the one or more dielectric members extends between a surface of the backplate to a surface of the movable diaphragm, wherein the backplate and the movable diaphragm form a second capacitor having a second capacitance based on the displacement of the movable diaphragm, and wherein the first capacitor is measured on a first side of the movable diaphragm and the second capacitor is measured on a second side of the movable diaphragm, the first side being opposite the second side; and a circuit coupled to the microelectromechanical microphone and configured to receive a first signal indicative of the first capacitance and a second signal indicative of the second capacitance, the circuit is further configured to generate a third signal indicative of a difference between the first capacitance and the second capacitance, the third signal is representative of an amplitude of the acoustic wave.

9. The device of claim 8, wherein the movable diaphragm defines openings, and wherein a surface of the first portion is in contact with a dielectric layer overlaying the substrate.

10. The device of claim 8, wherein the circuit is further configured to apply a first bias voltage to the backplate and a second bias voltage to the substrate, and wherein the circuit is further configured to apply a ground reference voltage to the movable diaphragm.

11. The device of claim 8, further comprising a housing comprising the microelectromechanical microphone and the circuit.

12. The device of claim 11, wherein the microelectromechanical microphone and the circuit are formed on a single die.

13. The device of claim 11, wherein the microelectromechanical microphone is formed on a first die and the circuit is formed on a second die, and wherein the first die and the second are electrically coupled.

* * * * *